US007431794B2

(12) United States Patent
Kanagawa et al.

(10) Patent No.: US 7,431,794 B2
(45) Date of Patent: Oct. 7, 2008

(54) PROCESS FOR PRODUCING LEATHER-LIKE SHEET

(75) Inventors: Yoshinori Kanagawa, Izumiotsu (JP); Toshio Niwa, Izumiotsu (JP); Toshifumi Tamaki, Tondabayashi (JP); Hisao Yoneda, Okayama (JP)

(73) Assignees: Dainippon Ink and Chemicals, Inc., Tokyo (JP); Kuraray Co., Ltd., Kurashiki-shi (JP)

( * ) Notice: Subject to any disclaimer, the term of this patent is extended or adjusted under 35 U.S.C. 154(b) by 0 days.

(21) Appl. No.: 10/590,142

(22) PCT Filed: Feb. 23, 2005

(86) PCT No.: PCT/JP2005/002888

§ 371 (c)(1),
(2), (4) Date: Aug. 21, 2006

(87) PCT Pub. No.: WO2005/083173

PCT Pub. Date: Sep. 9, 2005

(65) Prior Publication Data

US 2007/0169887 A1 Jul. 26, 2007

(30) Foreign Application Priority Data

Feb. 26, 2004 (JP) ..... 2004-051391

(51) Int. Cl.

| | |
|---|---|
| ***C09J 4/00*** | (2006.01) |
| ***C09J 101/00*** | (2006.01) |
| ***C09J 201/00*** | (2006.01) |
| ***A01N 1/00*** | (2006.01) |
| ***B32B 27/14*** | (2006.01) |
| ***B32B 3/00*** | (2006.01) |
| ***B05D 5/00*** | (2006.01) |
| ***C08G 18/00*** | (2006.01) |
| ***C08G 18/28*** | (2006.01) |

(52) U.S. Cl. ..... 156/331.4; 428/15; 428/198; 428/315.7; 427/243; 427/245; 427/247; 528/65; 528/80; 528/84; 521/116; 521/117

(58) Field of Classification Search ..... 428/15, 428/198, 315.7, 355 R, 355; 156/331.4; 528/65, 80, 84; 427/243, 245, 247; 521/116, 521/117

See application file for complete search history.

(56) References Cited

U.S. PATENT DOCUMENTS 4,551,518 A * 11/1985 Matsumoto et al. ..... 528/80

(Continued)

FOREIGN PATENT DOCUMENTS

JP 9-24590 1/1997

(Continued)

*Primary Examiner*—Philip C Tucker
*Assistant Examiner*—Michael N Orlando
(74) *Attorney, Agent, or Firm*—Edwards Angell Palmer & Dodge LLP

(57) ABSTRACT

A process for producing a leather-like sheet, wherein a skin-like layer composed of a resin composition (C) is formed on top of a fibrous substrate (E), comprising; heating and melting a moisture-curable polyurethane hot-melt resin composition (C) which contains a hot-melt urethane prepolymer (A) having isocyanate groups at molecular terminal ends and a colorant (B), and applying said heated and melted resin composition (C) to either [1] a releasable substrate (D) and then bonding the coated surface to a fibrous substrate (E), or [2] a fibrous substrate (E) and then bonding the coated surface to a releasable substrate (D); wherein the colorant (B) contains a polyol with a number average molecular weight within a range from 1,000 to 20,000 as a vehicle (B-1), and a pigment (B-2).

13 Claims, 2 Drawing Sheets

U.S. PATENT DOCUMENTS

| | | | | |
|---|---|---|---|---|
| 4,764,426 | A * | 8/1988 | Nakamura et al. | 428/400 |
| 6,322,851 | B1 * | 11/2001 | Adachi et al. | 427/246 |
| 6,479,153 | B1 * | 11/2002 | Kato et al. | 428/423.7 |
| 2002/0018892 | A1 * | 2/2002 | Satake et al. | 428/355 R |
| 2003/0017322 | A1 * | 1/2003 | Kim | 428/315.7 |
| 2003/0039772 | A1 * | 2/2003 | Takeyama et al. | 428/15 |
| 2003/0203146 | A1 * | 10/2003 | Nakanishi | 428/40.1 |
| 2006/0079589 | A1 * | 4/2006 | Tadokoro et al. | 521/155 |

FOREIGN PATENT DOCUMENTS

| | | |
|---|---|---|
| JP | 2000-54272 | 2/2000 |
| JP | 2002-348347 | 12/2002 |
| JP | 2003-49147 | 2/2003 |
| JP | 2003-246830 | 9/2003 |
| JP | 2003-306523 | 10/2003 |
| JP | 2003-306526 | 10/2003 |

* cited by examiner

PROCESS FOR PRODUCING LEATHER-LIKE SHEET

TECHNICAL FIELD

The present invention relates to a process for producing a leather-like sheet that can be used in footwear such as women's shoes, sports shoes and sandals, as well as in furniture and clothing and the like.

BACKGROUND ART

Conventionally, leather-like sheets containing a skin-like layer (also commonly referred to as a grain side layer) are used in a multitude of applications, including footwear, clothing, bags, and furniture and the like.

The basic construction of a leather-like sheet is a laminated structure including a skin-like layer, an adhesive layer, and a fibrous substrate. Examples of suitable materials for the fibrous substrate include base fabrics such as nonwoven, woven and knitted fabrics, materials in which a polyurethane resin or the like has been impregnated into any of these base fabrics, and materials in which a porous layer containing a resin such as a polyurethane resin has been provided on the surface of one of these substrates.

A number of processes for producing leather-like sheets are already known. Representative examples of these processes include (1) a process in which an organic solvent solution of a polyurethane resin that has been colored using any of a variety of colorants is applied, by gravure coating, to the surface of an aforementioned fibrous substrate on which has been provided a porous surface layer containing a resin such as a polyurethane resin, and following removal of the organic solvent by drying, an embossing roll or the like is pressed onto the surface of the applied coating, thereby forming a skin-like layer with a leather-like indentation pattern (leather-like uneven pattern), and (2) a process in which an organic solvent solution of a colored polyurethane resin is applied to the surface of a release paper with a leather-like indentation pattern, the organic solvent is removed by drying, and the resulting skin-like layer is then bonded to a fibrous substrate using an adhesive.

In all of the above types of conventional processes for producing leather-like sheets, an organic solvent solution of a polyurethane resin is used. As a result, removal of the organic solvent by drying or extraction is essential at some point during the production steps. This raises a number of problems, including the deleterious effect of organic solvents on human health, pollution of the atmosphere or waterways, and the large energy requirements and production costs associated with evaporating the organic solvent, and as a result, the development of processes that use either water-based polyurethane resins or solvent-free polyurethane resins, with no requirement for the use of organic solvents, has been keenly sought by industry.

Furthermore, depending on the application, there are also demands for high levels of abrasion resistance, or deeper degrees of coloring, and in order to meet these demands, skin-like layers with increased film thickness may be required. However, in a conventional process wherein following application of an organic solvent solution of a polyurethane resin, the skin-like layer is formed by removal of the organic solvent by drying, the maximum film thickness achievable using a single application is only approximately 150 μm. Accordingly, a plurality of application repetitions is required, but this leads to further increases in the discharge quantity of organic solvent, the energy requirements, and the production costs.

One process that is being investigated as a potential countermeasure to the above problems is a process that uses a water-based polyurethane resin instead of an organic solvent-based polyurethane resin. However, the leather-like sheets obtained using a water-based polyurethane resin generally exhibit inferior water resistance and durability, meaning their practical applicability is poor. Furthermore, in those cases where a skin-like layer with increased film thickness is required, a plurality of application repetitions is required, and as a result, the number of production steps and the costs are still problematic, meaning the range of applications to which this process can be applied is extremely limited.

Furthermore, a process is also known wherein a thermoplastic polyurethane with a specific composition is applied to the surface of a release paper with a leather-like indentation pattern using melt extrusion, and the thermoplastic polyurethane film layer on top of the release paper is then transferred and bonded to a fibrous substrate using a compression roller or the like (for example, see patent reference 1). In the case of this process, high temperature conditions of 180 to 230° C. are required to melt the thermoplastic polyurethane, and if the thermoplastic polyurethane resin is colored in advance using a colorant such as a pigment, then the heat during the melt extrusion can cause discoloration of the colorant. Furthermore, because the temperature of the molten-state thermoplastic polyurethane resin is very high, at 180° C. or higher, the thermoplastic polyurethane resin undergoes rapid cooling when applied to the release paper, meaning the polyurethane may not penetrate into some of the fine indentations (irregularities, ruggedness) within the release paper, resulting in a poor reproduction of the indentation pattern. In addition, because of the high temperature, oxidation decomposition and hydrolysis of the molten thermoplastic polyurethane becomes more likely, and in order to prevent these reactions, large-scale apparatus must be used to exclude oxygen and moisture.

Furthermore, a technique that uses a moisture-curable polyurethane holt-melt resin composition is also being investigated as a potential production process that uses a solvent-free polyurethane resin. For example, a process for producing a polyurethane leather-like sheet has been disclosed in which a solid moisture-curable polyurethane (a moisture-curable polyurethane hot-melt resin composition) can be used as the skin-like layer for a leather-like sheet, and this skin-like layer and a substrate are then bonded together using the moisture-curable polyurethane as an adhesive (for example, see patent reference 2).

In this process, steps are required for preparing the skin-like layer in advance, and then bonding the skin-like layer and the substrate together using the moisture-curable polyurethane hot-melt resin composition as an adhesive, and consequently the production process is complex. Furthermore, leather-like sheets are usually colored, meaning in order to use the moisture-curable polyurethane hot-melt resin composition as the skin-like layer, this composition must be colored in some manner. However, coloring a moisture-curable polyurethane hot-melt resin composition in such a manner that a favorable external appearance is obtained is far from simple. Only limited knowledge is available concerning such coloring methods, and the references mentioned above contain absolutely no comment on a coloring method.

Patent Reference 1:

Japanese Unexamined Patent Application, First Publication No. Hei 9-24590

Patent Reference 2:

Japanese Unexamined Patent Application, First Publication No. 2000-54272

DISCLOSURE OF INVENTION

Problems to be Solved by the Invention

In order to obtain a leather-like sheet with excellent design properties, including exhibiting uniform coloring with no discoloration, color irregularities or the like, as well as a soft texture and excellent levels of abrasion resistance and hydrolysis resistance, there has been no option with the conventional technology described above but to use organic solvent-based polyurethane resins, which are potentially harmful to people and are the cause of various environmental problems. Moreover, the production process has required the removal of the organic solvent using a method such as drying or extraction, and this organic solvent removal has required an enormous level of energy consumption. In addition, formation of a skin-like layer with the increased film thickness necessary to achieve a higher level of abrasion resistance and deeper coloring has proven problematic, and even if an attempt is made to increase the film thickness, then as described above, this results in further increases in the discharge quantity of organic solvent, the energy requirements, and the production costs.

Furthermore, even if in order to avoid the above problems, a technique is employed in which the aforementioned thermoplastic polyurethane with a specific composition is coated onto a fibrous substrate by melt extrusion to from a skin-like layer, problems still arise, including discoloration of the colorant as a result of the heat generated during melting, and the fact that the indentation pattern formed within the skin-like layer is not always a faithful reproduction of the original indentation pattern.

In addition, a technique in which a moisture-curable polyurethane hot-melt resin composition is used as both the skin-like layer and the adhesive layer of the leather-like sheet is also known. However, the process is complex, requiring the skin-like layer to be prepared in advance, with the adhesive then used to bond the skin-like layer to the substrate.

An object of the present invention is to provide a production process for a leather-like sheet, which uses no organic solvent, and which is capable, via a series of simple and labor-saving steps, of producing a leather-like sheet that exhibits no discoloration of the colorant, color irregularities, or the like offers excellent design properties with favorable coloring, and also exhibits excellent properties of texture, abrasion resistance, and softness and the like.

Another object of the present invention is to provide a production process which is capable of producing a leather-like sheet that exhibits excellent design properties, including favorable coloring and faithful reproduction of an indentation pattern, even when the skin-like layer has a large film thickness exceeding 200 μm.

MEANS FOR SOLVING THE PROBLEMS

The inventors of the present invention surmised that if a comparatively low molecular weight hot-melt urethane prepolymer was used instead of the aforementioned conventional thermoplastic polyurethane as the solvent-free polyurethane resin for forming the skin-like layer of a leather-like sheet, then problems such as discoloration and color irregularity should be able to be resolved, enabling coloring to the desired hue, and this lead them to commence intensive research.

First, the inventors investigated methods in which a hot-melt urethane prepolymer containing isocyanate groups at the molecular terminal ends, obtained by reacting a polyol and a polyisocyanate, was mixed in a heated and melted state with any of a variety of different pigments, or methods in which a master batch was first prepared by mixing together some of the hot-melt urethane prepolymer and any of a variety of different pigments in a heated and melted state, and this master batch was then added to the aforementioned hot-melt urethane prepolymer, but in both cases, satisfactory results were not obtainable. As a result of further research, the inventors discovered that by producing the colorant in advance using any of a variety of pigments together with a polyol with a number average molecular weight within a range from 1,000 to 20,000 as a vehicle, and then using this colorant, an aforementioned hot-melt urethane prepolymer could be favorably colored.

Furthermore, a moisture-curable polyurethane hot-melt resin composition containing an aforementioned hot-melt urethane prepolymer and an aforementioned colorant exhibits excellent adhesion to the various types of fibrous substrates used as substrates for leather-like sheets. As a result, the inventors discovered that the additional step that is required in conventional techniques, wherein the skin-like layer is prepared in advance, and an adhesive is then used to bond this skin-like layer to a substrate, can be omitted, enabling a dramatic improvement in the efficiency of the production process.

In other words, by heating and melting the moisture-curable polyurethane hot-melt resin composition, applying the molten composition to either one of a releasable substrate and a fibrous substrate, and then bonding the releasable substrate and the fibrous substrate together, the inventors developed a process for producing a leather-like sheet which uses no adhesive, and is capable of forming a skin-like layer composed of the resin composition directly on top of the fibrous substrate.

In addition, in a process for producing a leather-like sheet that uses an aforementioned moisture-curable polyurethane hot-melt resin composition, a skin-like layer with a film thickness of 200 μm or greater can be formed in a single application step. Furthermore, the inventors also discovered that the colorant underwent no discoloration during the production steps, enabling a leather-like sheet with uniform coloring and excellent design properties to be obtained.

Moreover, in those cases where a releasable substrate with a leather-like indentation pattern is used in the process for producing a leather-like sheet, the indentation pattern is transferred favorably to the skin-like layer. As a result, a leather-like sheet with a faithful reproduction of the indentation pattern can be obtained.

In other words, a first aspect of the present invention provides a process for producing a leather-like sheet, wherein a skin-like layer composed of a resin composition (C) is formed on top of a fibrous substrate (E), comprising;

heating and melting a moisture-curable polyurethane hot-melt resin composition (C) which contains a hot-melt urethane prepolymer (A) having isocyanate groups at molecular terminal ends and a colorant (B), and applying said heated and melted resin composition (C) to either [1] a releasable substrate (D) and then bonding the coated surface to a fibrous substrate (E), or [2] a fibrous substrate (E) and then bonding the coated surface to a releasable substrate (D); wherein the colorant (B) contains a polyol with a number average molecular weight within a range from 1,000 to 20,000 as a vehicle (B-1), and a pigment (B-2).

Furthermore, the present invention also provides a process for producing a leather-like sheet wherein the releasable substrate has an indentation pattern.

EFFECTS OF THE INVENTION

According to the present invention, a process for producing a leather-like sheet can be provided which uses no organic solvents, which have a deleterious effect on human health and cause pollution of the atmosphere or waterways, meaning drying and removal of the organic solvent during the production process is unnecessary, enabling significant reductions to be made in both the level of energy consumption and the production costs, and moreover, which is capable of producing a leather-like sheet which offers excellent design properties, with favorable coloring and no discoloration or color irregularities, as well as excellent properties of texture, abrasion resistance, and softness and the like.

Furthermore, according to the present invention, the additional step that is required in conventional techniques, wherein the skin-like layer is prepared in advance, and an adhesive is then used to bond this skin-like layer to a substrate, can be omitted, enabling a dramatic improvement in the efficiency of the production process.

In addition, a production process can be provided which is capable of producing a leather-like sheet with excellent design properties, including favorable coloring and faithful reproduction of an indentation pattern, even when the skin-like layer has a large film thickness exceeding 200 μm.

DESCRIPTION OF THE REFERENCE SYMBOLS

1 Releasable substrate

Figure 1:
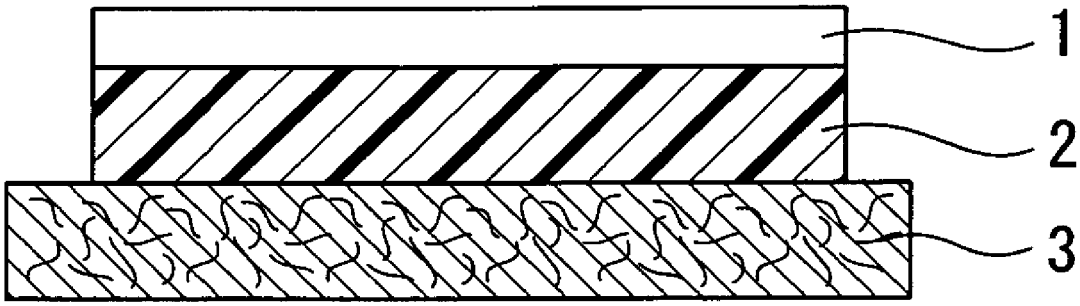
FIG. 1 is a schematic cross-sectional view of a leather-like sheet obtained using a process for producing a leather-like sheet that uses a moisture-curable polyurethane hot-melt resin composition according to an embodiment of the present invention.

2 Skin-like layer formed from moisture-curable polyurethane hot-melt resin composition

3 Fibrous substrate

4*a* to 4*c* Leather-like sheet

5 Two-components continuous mixing device

6 Application roller

7 Press roller

BEST MODE FOR CARRYING OUT THE INVENTION

As follows is a description of the most preferred embodiments for implementing the present invention.

The present invention is a process for producing a leather-like sheet, wherein a skin-like layer composed of a resin composition (C) is formed on top of a fibrous substrate (E), comprising;

heating and melting a moisture-curable polyurethane hot-melt resin composition (C) which contains a hot-melt urethane prepolymer (A) having isocyanate groups at molecular terminal end(s) and a colorant (B), and applying said heated and melted resin composition (C) to either [1] a releasable substrate (D) and then bonding the coated surface to a fibrous substrate (E), or [2] a fibrous substrate (E) and then bonding the coated surface to a releasable strate (D), wherein the colorant (B) contains a polyol with a number average molecular weight within a range from 1,000 to 20,000 as a vehicle (B-1), and a pigment (B-2).

First is a description of the hot-melt urethane prepolymer (A) that contains isocyanate groups at the molecular terminal ends used in the production process of the present invention.

The hot-melt urethane prepolymer (A) used in the present invention is obtained by reacting together a polyol and a polyisocyanate, and exhibits the two characteristics of being "moisture-curable" (also referred to as being "moisture cross-linking reactive") and "hot-meltable".

The moisture curability of the urethane prepolymer (A) originates from a cross-linking reaction initiated by a reaction between the isocyanate groups of the urethane prepolymer (A) and moisture (water), and is consequently attributable to the isocyanate groups.

As a result of the moisture-curability of this urethane prepolymer (A), the moisture-curable polyurethane hot-melt resin composition (C) used in the present invention can be applied to a substrate in a molten state, and then cured via a reaction with moisture (water) contained within the atmosphere or the substrate. This curing causes an increase in the molecular weight, forming a skin-like layer with excellent durability that also exhibits excellent adhesion to the surface of fibrous substrates.

On the other hand, the hot-melt property of the urethane prepolymer (A) stems from the molecular structure of the selected prepolymer. This property means that the material is either solid or so viscous as to be impossible to apply to a substrate at room temperature, but then melts under heating to form a liquid that can be applied, and then solidifies on cooling to yield a material that exhibits favorable adhesiveness. The term "hot-melt" is used generically to describe this property or a material that exhibits this property.

This urethane prepolymer (A) with hot-melt characteristics can be mixed with the colorant (B) in a molten state, and following application to a substrate, cooling causes a rapid rise in the viscosity, leading to remanifestation of the cohesive forces and solidification of the surface portion within a short period of time. Accordingly, deterioration in the design characteristics such as the surface appearance or the surface quality, or loss of the soft texture of the surface during rolling or the like of the leather-like sheet immediately following bonding can be prevented.

Those materials termed urethane prepolymers are generally of low molecular weight. However, those skilled in the art also refer to materials with number average molecular weights of several tens of thousands as urethane prepolymers, and the present invention is also able to use urethane prepolymers (A) with number average molecular weights of several tens of thousands.

The number average molecular weight of the urethane prepolymer (A) used in the present invention is preferably within a range from 500 to 30,000, and even more preferably from 1,000 to 10,000. Provided the number average molecular weight of the urethane prepolymer (A) falls within this range, the operational stability and mixing efficiency during molten-state mixing with the colorant (B) are favorable, and a skin-like layer can be formed that exhibits excellent pigment dispersion, as well as superior properties of softness, mechanical strength, abrasion resistance, and hydrolysis resistance. Furthermore, in terms of the process temperature, whereas the thermoplastic polyurethane used in the aforementioned conventional technology required a process temperature of approximately 200° C., the urethane prepolymer (A) used in the present invention can be melted and applied at a comparatively low temperature of 60 to 170° C., meaning discoloration of the colorant (B) caused by the heat applied during melting can be significantly reduced.

The melt viscosity of the urethane prepolymer (A) at 125° C., measured using a cone-plate viscometer, is preferably within a range from 100 to 100,000 mPa·s, and even more preferably from 1,000 to 50,000 mPa·s. Provided the melt viscosity of the urethane prepolymer (A) falls within the above range, the operational stability and mixing efficiency during molten-state mixing of the urethane prepolymer (A) and the colorant (B) are favorable, excellent pigment dispersion is obtained, and the permeability of the moisture-curable polyurethane hot-melt resin composition (C) into the fibrous substrate (E) is favorable, enabling excellent peel strength to be achieved.

The urethane prepolymer (A) can be produced by reacting a polyol with a polyisocyanate, under conditions in which the isocyanate groups of the polyisocyanate are present in excess relative to the hydroxyl groups of the polyol. During this reaction, the equivalence ratio (isocyanate groups within the polyisocyanate)/(hydroxyl groups within the polyol) is preferably within a range from 1.1 to 5.0, and even more preferably from 1.5 to 3.0.

The quantity of isocyanate groups within the urethane prepolymer (A), relative to the weight of the urethane prepolymer (A), is preferably within a range from 0.5 to 10.0% by mass, and even more preferably from 1.0 to 6.0% by mass. Provided the isocyanate group content falls within this range, the melt viscosity following heating and melting falls within a suitable range, and when the molten-state prepolymer is mixed with the colorant (B), not only are superior levels of operational stability and pigment dispersion achieved, but the subsequent reaction between moisture (water) and the isocyanate groups yields favorable characteristics such as a suitable cross-linking density, a soft texture, and good durability.

Examples of polyols that can be used in the production of the urethane prepolymer (A) used in the present invention include polyester polyols, polyether polyols, polycarbonate polyols, acrylic polyols, polyolefin polyols, castor oil polyols, silicon-modified polyols, or mixtures thereof. These polyols can be used either alone, or in combinations of two or more different compounds.

There are no particular restrictions on the polyether polyols that can be used in the production of the urethane prepolymer (A), and conventional polyester polyols can be used. Of these, polyoxyalkylene glycols with a number average molecular weight within a range from 500 to 10,000 are preferred. More specific examples include polymers produced by ring-opening polymerization of one or more compounds selected from a group consisting of ethylene oxide, propylene oxide, butylene oxide and styrene oxide and the like, using polypropylene glycol, polytetramethylene glycol or any of the various low molecular weight polyols as an initiator. Furthermore, polymers produced by a ring-opening addition of γ-butyrolactone or ϵ-caprolactone or the like to the above polyether polyols can also be used. These polyols can be used either alone, or in combinations of two or more different materials.

Examples of polyester polyols that can be used in the production of the urethane prepolymer (A) include polyester polyols obtained by condensation of any of a variety of conventional low molecular weight polyols and a polybasic acid.

Examples of low molecular weight polyols that can be used in the production of a polyester polyol include one or more compounds selected from amongst ethylene glycol, 1,2-propylene glycol, 1,3-propylene glycol, 1,3-butanediol, 1,4-butanediol, 2,2-dimethyl-1,3-propanediol, 1,6-hexanediol, 3-methyl-1,5-pentanediol, 1,8-octanediol, diethylene glycol, triethylene glycol, dipropylene glycol, tripropylene glycol, cyclohexane-1,4-diol, and cyclohexane-1,4-dimethanol. Furthermore, addition products produced by adding any of the various alkylene oxides to bisphenol A can also be used.

Furthermore, examples of polybasic acids that can be used in the production of an aforementioned polyester polyol include one or more compounds selected from amongst succinic acid, maleic acid, adipic acid, glutaric acid, pimelic acid, suberic acid, azelaic acid, sebacic acid, dodecanedicarboxylic acid, phthalic acid, isophthalic acid, terephthalic acid, and hexahydroisophthalic acid. Furthermore, polymers formed by ring opening polymerization of γ-butyrolactone or ϵ-caprolactone or the like, using an aforementioned low molecular weight polyol as an initiator, can also be used.

Furthermore, examples of polycarbonate polyols that can be used in the production of the urethane prepolymer (A) include poly(alkylene carbonate) diols produced by a condensation reaction between an aforementioned low molecular weight polyol, and one or more compounds selected from amongst diaryl carbonates, dialkyl carbonates, and alkylene carbonates and the like.

In addition, the low molecular weight polyols that can be used in the production of the aforementioned polyester polyols can also be used as the polyol in the production of the urethane prepolymer (A).

Furthermore, the glass transition temperature (Tg) of the cured product obtained on moisture curing of the urethane prepolymer (A) is preferably within a range from −70 to 25° C. Provided the Tg value falls within this range, a leather-like sheet with an excellent soft texture from low temperatures through to room temperature, and excellent flexibility can be obtained.

Furthermore, the glass transition temperature (Tg) of the moisture-cured product of the urethane prepolymer (A) is affected by the Tg value of the polyol used in producing the prepolymer (A). Of the polyols that can be used during production of the urethane prepolymer (A), polyether polyols with a glass transition temperature within a range from −70 to 25° C. are preferred, and of these, polyoxyalkylene glycols with a number average molecular weight within a range from 500 to 10,000 are particularly preferred. Polytetramethylene glycol enables the production of a leather-like sheet with excellent low temperature flexibility, and is consequently particularly desirable.

Furthermore, the polyol used in the formation of the urethane prepolymer (A) preferably contains at least 40% by mass of the aforementioned polytetramethylene glycol. By ensuring such a quantity, a leather-like sheet with a superior soft texture from low temperatures through to room temperature, and excellent flexibility can be obtained.

Furthermore, in those cases where a polyether polyol such as the aforementioned polytetramethylene glycol is used, by also using a polyester polyol, the mechanical characteristics of the obtained skin-like layer such as the abrasion resistance and blocking resistance can also be favorably improved.

Furthermore, in order to ensure that hot-melt characteristics suited to the production process of the present invention are imparted to the urethane prepolymer (A), the polyol used preferably has a dry bulb softening point, measured using a ring and ball method with a rate of temperature increase of 5° C./minute, that falls within a range from 30 to 160° C., and even more preferably from 40 to 120° C. Specific examples of suitable materials include polyester polyols obtained by polycondensation of a low molecular weight polyol with an even number of carbon atoms selected from amongst the low molecular weight polyols described above, and a polybasic acid with an even number of carbon atoms selected from amongst the polybasic acids described above, or polycarbonate polyols obtained using, as a starting material, a low molecular weight polyol with an even number of carbon atoms selected from amongst the low molecular weight polyols described above.

Examples of polyisocyanates that can be used in the production of the urethane prepolymer (A) include aromatic diisocyanates such as phenylene diisocyanate, tolylene diisocyanate (TDI), 4,4'-diphenylmethane diisocyanate, 2,4'-diphenylmethane diisocyanate, naphthalene diisocyanate, and xylylene diisocyanate; aliphatic diisocyanates or alicyclic diisocyanates such as hexamethylene diisocyanate, lysine diisocyanate, cyclohexane diisocyanate, isophorone diisocyanate, dicyclohexylmethane diisocyanate, and tetramethylxylylene diisocyanate; and polymeric MDI containing dimers or trimers of 4,4'-diphenylmethane diisocyanate (MDI). These compounds can be used either alone, or in combinations of two or more different compounds.

Of these, taking into consideration factors such as resistance to discoloration under light and reactivity with water vapor or moisture (water), xylylene diisocyanate is particularly preferred.

Furthermore, a hot-melt urethane prepolymer (a) that includes both hydrolysable alkoxysilyl groups and isocyanate groups at the molecular terminal ends can also be used as the urethane prepolymer (A) used in the present invention. This hot-melt urethane prepolymer (a) can also be used in combination with a hot-melt urethane prepolymer that contains no hydrolysable alkoxysilyl groups at the molecular terminal ends. By using this hot-melt urethane prepolymer (a), the wetting characteristics of the urethane prepolymer (A) and pigment can be improved, and a skin-like layer with even more vivid color toning can be obtained with no loss in the mechanical strength of the skin-like layer. In addition, increases in the viscosity of the moisture-curable polyurethane hot-melt resin composition (C) caused by heat history can also be suppressed.

The aforementioned hot-melt urethane prepolymer (a) that includes both hydrolysable alkoxysilyl groups and isocyanate groups at the molecular terminal ends can be produced, for example, by reacting a polyol, a polyisocyanate, and a compound that contains both an active hydrogen atom-containing group that exhibits reactivity relative to isocyanate groups, and a hydrolysable alkoxysilyl group. For example, a hot-melt urethane prepolymer (a) can be produced by reacting an aforementioned hot-melt urethane prepolymer (A) containing isocyanate groups at the molecular terminal ends with a compound that contains both an active hydrogen atom-containing group that exhibits reactivity relative to isocyanate groups, and a hydrolysable alkoxysilyl group.

In this case, the equivalence ratio [(active hydrogen atom-containing groups within the compound containing both the active hydrogen atom-containing group and a hydrolysable alkoxysilyl group)/(isocyanate groups within the prepolymer (A))] is preferably within a range from 0.05 to 0.80, and even more preferably from 0.1 to 0.5. Provided the equivalence ratio falls within this range, molten-state mixing of the urethane prepolymer (A) and the colorant (B) can be conducted with favorable operational stability and no gelling, and the resulting pigment dispersion is excellent. In addition, a favorable balance is also achieved between improving the adhesive strength by controlling the penetration of the moisture-curable polyurethane hot-melt resin composition (C) into the fibrous substrate (E) via a suitable increase in viscosity, and ensuring favorable durability for the resulting leather-like sheet.

The moisture curability of the urethane prepolymer (A) used in the present invention is caused by a reaction between the isocyanate groups of the urethane prepolymer (A) and moisture (water), but in those cases where an aforementioned hot-melt urethane prepolymer (a) is used, a reaction also occurs between the hydrolysable alkoxysilyl groups of the hot-melt urethane prepolymer (a) and the moisture (water).

Examples of the compound that contains both an active hydrogen atom-containing group that displays reactivity relative to isocyanate groups, and a hydrolysable alkoxysilyl group, wherein the compound is used in the production of the aforementioned hot melt urethane prepolymer (a), include compounds represented by a general formula (1) shown below.

General formula (1)

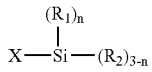

(In the general formula (1), $R_1$ represents a hydrogen atom, or a monovalent organic group selected from a group consisting of alkyl groups, aryl groups, and aralkyl groups, $R_2$ represents a halogen atom, or an alkoxyl group, acyloxy group, phenoxy group, iminoxy group, or alkenyloxy group, and n represents an integer of 0, 1, or 2. Furthermore, X represents an organic residue containing one or more amino groups, hydroxyl groups, or mercapto groups.)

Examples of the active hydrogen atom-containing group within the compound represented by the general formula (1) include an amino group, hydroxyl group, and mercapto group. Among them, an amino group is preferred as it exhibits superior reactivity with an isocyanate group.

Furthermore, examples of the hydrolysable alkoxysilyl group within the compound represented by the general formula (1) include easily hydrolyzable silyl groups such as a halosilyl group, alkoxysilyl group, acyloxysilyl group, phenoxysilyl group, iminoxysilyl group, or alkenyloxysilyl group.

Of these hydrolysable alkoxysilyl groups, a trimethoxysilyl group, triethoxysilyl group, (methyl)dimethoxysilyl group, or (methyl)diethoxysilyl group, and the like are preferred, as such groups provide a more ready progression of the cross-linking reaction with moisture (water).

Specific examples of the compound that contains both an active hydrogen atom-containing group that exhibits reactivity relative to isocyanate groups, and a hydrolysable alkoxysilyl group, include γ-(2-aminoethyl)aminopropyltrimethoxysilane, γ-(2-hydroxylethyl)aminopropyltrimethoxysilane, γ-(2-aminoethyl)aminopropyltriethoxysilane, γ-(2-hydroxylethyl)aminopropyltriethoxysilane, γ-(2-aminoethyl)aminopropylmethyldimethoxysilane, γ-(2-aminoethyl)aminopropylmethyldiethoxysilane, γ-(2-hydroxylethyl)aminopropylmethyldimethoxysilane, and γ-(2-hydroxylethyl)aminopropylmethyldiethoxysilane, as well as γ-(N,N-di-2-hydroxylethyl)aminopropyltriethoxysilane, γ-aminopropyltrimethoxysilane, γ-aminopropyltriethoxysilane, γ-aminopropylmethyldimethoxysilane, γ-aminopropylmethyldiethoxysilane, γ-(N-phenyl)aminopropyltrimethoxysilane, γ-mercaptopropyltrimethoxysilane, and γ-mercaptophenyltrimethoxysilane. These compounds can be used either alone, or in combinations of two or more different compounds.

A variety of conventional methods can be used to produce the urethane prepolymer (A) used in the present invention, and there are no particular restrictions on the method employed. Suitable examples include a method in which either the polyol, from which any moisture has been removed, is added in a dropwise manner to the polyisocyanate, or the polyisocyanate is mixed with the moisture-free polyol, and the resulting mixture is then heated to effect a batch-type reaction, and a method in which the polyol from which any moisture has been removed and the polyisocyanate are heated, and the two components are then supplied to an extruder in a predetermined ratio, and reacted using a continuous extrusion reaction system until the hydroxyl groups of the polyol have all reacted.

Furthermore, by adding a compound that contains both an active hydrogen atom-containing group that exhibits reactivity relative to isocyanate groups, and a hydrolysable alkoxysilyl group in a dropwise manner to the hot-melt urethane prepolymer (A) containing isocyanate groups at the molecular terminal ends prepared in the manner described above, and then conducting subsequent heat treatment as required, a hot-melt urethane prepolymer (a) that contains hydrolysable alkoxysilyl groups in addition to the isocyanate groups at the molecular terminal ends can be produced.

This reaction can be conducted without solvent, although in some cases, the reaction may also be conducted in an organic solvent, with the solvent being subsequently removed. In those cases where the reaction is conducted in an organic solvent, any of various known organic solvents can be used, including ethyl acetate, n-butyl acetate, methyl ethyl ketone, and toluene. In such cases, the solvent must be removed following reaction, using a suitable solvent removal method such as heating under reduced pressure.

Next is a description of the colorant (B) used in the present invention.

The aforementioned colorant (B) can include a pigment (B-2), a vehicle (B-1) that imparts flowability, transferability, more favorable drying characteristics, adhesiveness and dry film characteristics to the colorant, and if required, may also include any of a variety of conventional additives.

The vehicle (B-1) is preferably a polyol with a number average molecular weight within a range from 1,000 to 20,000. A colorant (B) that uses this type of vehicle (B-1) exhibits superior operational stability and pigment dispersion when subjected to molten-state mixing with the aforementioned urethane prepolymer (A), enabling production of a leather-like sheet with uniform coloring and excellent design characteristics. Furthermore, there is no loss in the mechanical strength of the leather-like sheet as a result of blending the colorant (B).

There are no particular restrictions on the polyol used as the vehicle (B-1), and suitable examples include polyester polyols, polyether polyols, polycarbonate polyols, acrylic polyols, polyolefin polyols, castor oil polyols, and silicon-modified polyols. Of these, in terms of obtaining a leather-like sheet with a superior soft texture from low temperatures through to room temperature, polyoxyalkylene glycols with a number average molecular weight within a range from 1,000 to 20,000 are preferred.

More specific examples include polyols produced by a ring-opening polymerization of one or more compounds selected from a group consisting of alkylene oxides such as ethylene oxide, propylene oxide and butylene oxide, and styrene oxide, using a low molecular weight polyol such as polypropylene glycol or polytetramethylene glycol as an initiator, or polymers produced by a ring-opening addition of γ-butyrolactone or ε-caprolactone or the like to an aforementioned low molecular weight polyol. Of these possibilities, in terms of achieving favorable wetting characteristics with the pigment, and obtaining a leather-like sheet that exhibits a superior texture and favorable mechanical characteristics, polypropylene glycol and polytetramethylene glycol are particularly desirable. These materials can be used either alone, or in combinations of two or more different materials.

Suitable examples of the aforementioned pigment (B-2) include inorganic pigments such as titanium oxide, zinc oxide, zinc white, carbon black, ferric oxide (red iron oxide), lead chromate (molybdate orange), chrome yellow, yellow iron oxide, ochre, ultramarine blue, and cobalt green, as well as organic pigments such as azo-based pigments, naphthol-based pigments, pyrazolone-based pigments, anthraquinone-based pigments, perylene-based pigments, quinacridone-based pigments, disazo-based pigments, isoindolinone-based pigments, benzimidazole-based pigments, phthalocyanine-based pigments, and quinophthalone-based pigments. Furthermore, extender pigments such as calcium bicarbonate, clay, silica, kaolin, talc, precipitated barium sulfate, barium carbonate, white carbon, and diatomaceous earth can also be used in combination with the above pigments. These pigments can be used either alone, or in combinations of two or more different materials.

The aforementioned colorant (B) can be produced by uniform mixing of the vehicle (B-1), the pigment (B-2), and any required additives. Furthermore, if required in order to improve the wetting characteristics and adhesiveness relative to resins, the pigment (B-2) may first be subjected to chemical surface treatment using a silane coupling agent, two or more pigments (B-2) may be combined during mixing, or additives such as conventional pigment dispersing agents or color separation prevention agents may be added.

There are no particular restrictions on the method used for the aforementioned mixing, and a conventional dispersion device such as a planetary mixer, ball mill, pebble mill, sand mill, attritor, roll mill, high-speed impeller dispersion device or high-speed stone mill can be used. Of these, a dispersion device that is capable of heating, melting and mixing the vehicle (B-1) and the pigment (B-2) is particularly desirable.

The mixing ratio of the vehicle (B-1) and the pigment (B-2) is preferably a mass ratio within a range from (B-1)/(B-2)=95 to 20/5 to 80. Provided the mixing ratio of the vehicle (B-1) and the pigment (B-2) falls within this range, molten-state mixing of the urethane prepolymer (A) and the colorant (B) can be conducted with favorable operational stability and no gelling of the mixture, the resulting pigment dispersion is excellent, and a well disguised leather-like sheet which shows good concealing ability is obtained.

The moisture-curable polyurethane hot-melt resin composition (C) used in the present invention contains the hot-melt urethane prepolymer (A) and the colorant (B). This moisture-curable polyurethane hot-melt resin composition (C) can be obtained by uniform molten-state mixing of the hot-melt urethane prepolymer (A) and the colorant (B).

The mixing ratio of the aforementioned hot-melt urethane prepolymer (A) and the colorant (B) is preferably a mass ratio within a range from (A)/(B)=100/5 to 100/100, and even more preferably from (A)/(B)=100/10 to 100/60. Provided the mixing ratio falls within this range, molten-state mixing of the urethane prepolymer (A) and the colorant (B) can be conducted with favorable operational stability and no gelling, and the resulting pigment dispersion is excellent. In addition, a favorable balance is also achieved between improving the adhesive strength by controlling the penetration of the moisture-curable polyurethane hot-melt resin composition (C) into the fibrous substrate (E) via a suitable increase in viscosity, and ensuring favorable durability for the resulting leather-like sheet.

If required, the moisture-curable polyurethane hot-melt resin composition (C) used in the present invention may also include one or more additives such as urethanization catalysts, silane coupling agents, fillers, thixotropy imparting agents, adhesion imparting agents, waxes, thermal stabilizers, light stabilizers, fillers, fluorescent brighteners, or foaming agents, as well as thermoplastic resins, thermosetting resins, dyes, conductivity imparting agents, antistatic agents, moisture penetration improvers, water repellents, oil repellents, hollow foams, compounds containing water of crystallization, flame retardants, water absorbers, moisture absorbers, deodorizers, foam regulating agents, antifoaming agents, moldproofing agents, preservatives, antibacterial agents, pigment dispersing agents, inert gases, blocking prevention agents, hydrolysis prevention agents, or organic and/or inorganic water-soluble compounds for improving water absorption and promoting the moisture curing process.

There are no particular restrictions on the aforementioned urethanization catalysts, and conventional compounds can be used. For example, one or more materials selected from urethanization catalysts such as stannous octoate, di-n-butyltin diacetate, di-n-butyltin dilaurate, 1,8-diazabicyclo(5,4,0)undecene-7 (DBU), DBU-p-toluenesulfonate, DBU-formate, DBU-octoate, DBU-phenolate, amine-based catalysts, morpholine-based catalysts, bismuth nitrate, tin chloride, and iron chloride can be used.

Furthermore, in those cases where a hot-melt urethane prepolymer (a) that contains hydrolysable alkoxysilyl groups at the molecular terminal ends is used as the aforementioned urethane prepolymer (A), a conventional cross-linking catalyst can also be used if required. Suitable examples of catalysts that can be used include various acidic compounds such as malic acid, citric acid, phosphoric acid, and acidic phosphoric acid ester compounds, various basic compounds such as lithium hydroxide, sodium hydroxide, potassium hydroxide, and triethylenediamine, various metal-containing compounds such as tetraisopropyl titanate, di-n-butyltin diacetate, di-n-butyltin dilaurate, di-n-butyltin oxide, dioctyltin oxide, and di-n-butyltin maleate, and any other compounds typically used as cross-linking catalysts for hydrolysable alkoxysilanes.

There are no particular restrictions on the aforementioned silane coupling agents, and conventional materials can be used. Suitable examples include γ-glycidoxypropyltrimethoxysilane, γ-glycidoxypropylmethyldiethoxysilane, β-(3,4-epoxycyclohexyl)ethyltrimethoxysilane, γ-methacryloxypropyltrimethoxysilane, γ-mercaptopropyltrimethoxysilane, vinyltrimethoxysilane, and γ-chloropropyltrimethoxysilane.

There are no particular restrictions on the aforementioned fillers, and conventional materials can be used. Suitable examples include calcium carbonate, aluminum hydroxide, barium sulfate, kaolin, talc, carbon black, alumina, magnesium oxide, inorganic balloons, organic balloons, lithia tourmaline, and activated carbon.

Furthermore, there are no particular restrictions on the aforementioned thixotropy imparting agents, and conventional materials can be used. For example, surface-treated calcium carbonate, finely powdered silica, bentonite, and zeolite can be used.

There are no particular restrictions on the process used for producing the colored moisture-curable polyurethane hot-melt resin composition (C) by uniform molten-state mixing of the hot-melt urethane prepolymer (A) and the colorant (B), and a variety of conventional processes can be employed.

For example, processes can be used wherein the prepared urethane prepolymer (A) is heated and melted, and is then mixed in a predetermined ratio in a continuous manner with the colorant (B), using a batch-type mixer, a static mixer, a rotor-stator mixing device or the like.

During heating and melting of the urethane prepolymer (A), melting is preferably achieved by heating at a temperature within a range from 60 to 170° C., and if viscosity increases caused by heat history are also taken into consideration, then the melting is even more preferably achieved by heating at a temperature within a range from 80 to 140° C.

Furthermore, the colorant (B) is preferably held or heated at a temperature within a range from room temperature (23° C.) to 100° C. to ensure a liquid state (that is, a flowable state), and is preferably stirred and mixed with the urethane prepolymer (A), or even more preferably subjected to high-speed stirring and mixing in order to ensure a uniform resin composition.

The device used for the above high-speed stirring and mixing is preferably a two-components continuous mixing device with a structure that enables the molten state to be maintained.

The temperature setting for the two-components continuous mixing device is preferably set in accordance with factors such as product quality and productivity, but is usually preferably held within a range between the melting temperature of the urethane prepolymer (A) and the melting temperature +30° C. Provided the temperature setting falls within this range, uniform mixing and stirring of the moisture-curable polyurethane hot-melt resin composition (C) can be conducted effectively, and the operating characteristics are also excellent. By using the above temperature range and mixing method, problems such as colorant discoloration caused by heat history become almost non-existent.

Furthermore, the foam that is generated during the mixing of the urethane prepolymer (A) and the colorant (B) using the two-components continuous mixing device is preferably subjected to a defoaming treatment inside the device using a pressure reduction pump.

Furthermore, the colorant (B) can also be added and mixed during the production of the urethane prepolymer (A). For example, the targeted colored moisture-curable polyurethane hot-melt resin composition (C) can be obtained by a method in which either (1) the polyol, from which any moisture has been removed, and the colorant (B) are added and mixed in a dropwise manner to the polyisocyanate, or (2) the polyisocyanate is mixed with the moisture-free polyol and the colorant (B), and the resulting mixture is then heated to effect a batch-type reaction, or a method in which (3) the polyol from which any moisture has been removed, the polyisocyanate, and the colorant (B) are supplied in a predetermined ratio to an extruder while they are heated together and reacted using a continuous extrusion reaction system.

As follows is a description of the step of heating and melting the moisture-curable polyurethane hot-melt resin composition (C) used in the present invention and applying the composition to either a releasable substrate (D) or a fibrous substrate (E), thereby forming a skin-like layer composed of the resin composition (C) on top of the fibrous substrate (E).

The device for heating, melting and applying the moisture-curable polyurethane hot-melt resin composition (C) to the releasable substrate (D) or fibrous substrate (E) is preferably an application device that is capable of regulating the temperature within a range from 60 to 170° C., and suitable devices include a roll coater, a spray coater, a T-die coater, a knife coater, or a comma coater or the like. By using one of these devices, and either [1] applying the heated and melted moisture-curable polyurethane hot-melt resin composition (C) to a releasable substrate (D) and then bonding the coated surface to a fibrous substrate (E), or [2] applying the heated and melted moisture-curable polyurethane hot-melt resin composition (C) to a fibrous substrate (E) and then bonding the coated surface to a releasable substrate (D), thereby forming a skin-like layer composed of the resin composition (C) on top of the fibrous substrate (E), the targeted leather-like sheet can be produced. The releasable substrate (D) can be peeled off from the skin-like layer of the resin composition (C) once bonding with the aforementioned substrate and aging have been completed.

In one example of a preferred process, a roll coater in which the coater temperature can be controlled within a range from 30 to 200° C. is used, and the moisture-curable polyurethane hot-melt resin composition (C) is heated and melted with the temperature preferably set within a range from 60 to 170° C., and even more preferably from 80 to 140° C., the molten composition is then applied uniformly in a sheet-like manner to the top of a releasable substrate (D), and the coated surface is bonded to a fibrous substrate (E), thereby forming a skin-like layer of the resin composition (C) on top of the fibrous substrate (E). By using this process, the thickness of the skin-like layer of the resin composition (C) can be controlled more accurately.

Furthermore, the thickness of the skin-like layer formed from the moisture-curable polyurethane hot-melt resin composition (C) is preferably within a range from 30 to 800 μm. Provided the thickness falls within this range, the indentation pattern of the underlying fibrous substrate (E) is not exposed at the sheet surface, enabling a leather-like sheet with excellent surface quality and superior levels of softness and texture to be obtained.

According to the present invention, production can be completed with these simple and labor-saving steps, even if the skin-like layer has a large film thickness exceeding 200 μm. Even in such cases, a leather-like sheet can be provided that exhibits favorable coloring with no color irregularities, as well as excellent design properties and superior levels of texture, softness and the like.

Any substrate that exhibits releasability relative to the moisture-curable polyurethane hot-melt resin composition (C), or any substrate that has undergone release treatment can be used as the releasable substrate (D) used in the present invention. Suitable examples include release paper, release-treated fabrics (there are no particular restrictions on the fabric, and any fabric that has undergone release treatment is suitable), water repellent fabrics, olefin sheets or films formed from polyethylene resin or polypropylene resin, fluororesin sheets or films, and release paper-coated plastic films.

Examples of the above release paper-coated plastic films include those produced by coating a release paper with the type of polyurethane resin used for the skin-like layer within conventional leather-like sheets. Examples of these polyurethane resins used for skin-like layers include solvent-based, water-based, emulsion-based, and solvent-free polyurethane resins.

Furthermore, in order to impart surface design features to the leather-like sheet, the use of a releasable substrate (D) with an indentation pattern is preferred. Alternatively, following bonding of the coated surface of the moisture-curable polyurethane hot-melt resin composition (C) and the fibrous substrate (E), an embossing roll with an indentation pattern can be used to conduct a (heated) embossing treatment, either from on top of the releasable substrate (D) or directly onto the coated surface after the releasable substrate (D) has been removed, thereby forming an indentation pattern.

Furthermore, there are no particular restrictions on the fibrous substrate (E), and any of the nonwoven fabrics, woven fabrics, knitted fabrics or the like typically used for leather-like sheets, or even natural leather and the like, can be used as appropriate. Furthermore, nonwoven fabrics, woven fabrics or the like, or knitted fabrics that have been impregnated with at least one material selected from solvent-based, water-based, emulsion-based, and solvent-free polyurethane resins, acrylic resins, butadiene-based resins (SBR, NBR, and MBR) and the like can also be used. In addition, substrates in which a porous layer formed from any of a variety of resins is formed on the surface of one of the above substrates can also be used. Of the above possibilities, in order to obtain a leather-like sheet with a superior soft texture and excellent mechanical strength, a microfiber nonwoven fabric that has been impregnated with a polyurethane resin is preferred, and a substrate in which a porous layer has been provided on such a nonwoven fabric is even more desirable.

The leather-like sheet produced using the production process of the present invention may also be bonded to a separate substrate, using an adhesive such as a solvent-based, water-based, emulsion-based, solvent-free, or hot-melt adhesive applied across either the entire surface of the sheet, or in a dot pattern.

Furthermore, the leather-like sheet produced using the production process of the present invention may also be subjected to further processing using conventional methods. For example, the sheet may be coated with solvent-based, water-based, emulsion-based, solvent-free polyurethane resins or acrylic resins, or subjected to post-processing such as buffing to impart surface design features to the sheet.

Furthermore, in order to ensure even more precise control of the thickness of the leather-like sheet, it is preferably that a compression treatment is conducted using one or more pressing devices selected from amongst compression belt presses, nip rollers, and flat presses and the like, thereby controlling the accuracy of the thickness of the moisture-curable polyurethane hot-melt resin composition (C) such that the thickness is in a range from 30 to 800 μm.

Furthermore, aging conditions for the leather-like sheet obtained using the production process of the present invention typically entail an aging period of 1 to 7 days at a temperature of 20 to 40° C. and a relative humidity of 50 to 80%. Provided the aging conditions satisfy these ranges, the reaction between the moisture (water) and the residual isocyanate groups, and/or the hydrolysable alkoxysilyl groups within the moisture-curable polyurethane hot-melt resin composition (C) can proceed to completion, meaning a leather-like sheet with excellent mechanical strength can be obtained.

As follows is a description of embodiments of the present invention with reference to the drawings.

The drawings described below merely represent possible embodiments of the present invention, and in no way restrict the positions or the like of each region, provided the objects of the invention are satisfied.

FIG. 1 is a schematic cross-sectional view of a process for producing a leather-like sheet according to the present invention, wherein a moisture-curable polyurethane hot-melt resin composition has been heated and melted, and the molten-state resin composition has subsequently been either [1] applied to a releasable substrate 1 and the coated surface then bonded to a fibrous substrate 3, or [2] applied to a fibrous substrate 3 and the coated surface then bonded to a releasable substrate 1, thereby forming a skin-like layer 2 composed of the resin composition on top of the fibrous substrate 3.

Figure 2:
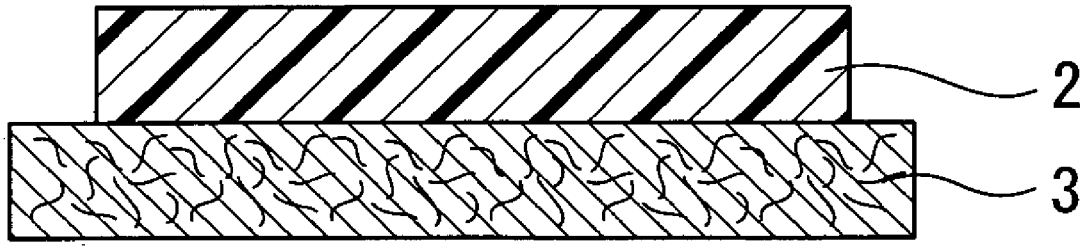
FIG. 2 is a schematic cross-sectional view of a leather-like sheet obtained using a process for producing a leather-like sheet that uses a moisture-curable polyurethane hot-melt resin composition according to an embodiment of the present invention.

FIG. 2 is a schematic cross-sectional view of a leather-like sheet obtained using one embodiment of a production process according to the present invention. This leather-like sheet is obtained by removing the releasable substrate 1 from the leather-like sheet shown in FIG. 1.

Figure 3:
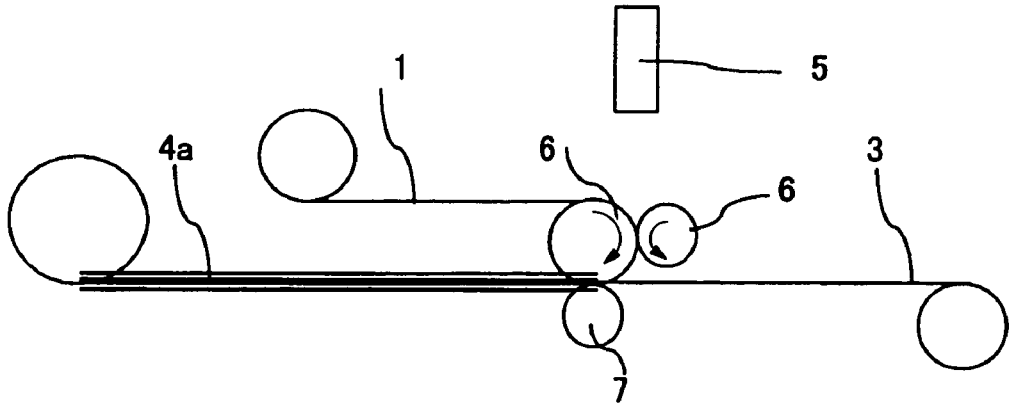
FIG. 3 is a schematic representation showing a process for producing a leather-like sheet that uses a moisture-curable polyurethane hot-melt resin composition according to an embodiment of the present invention.

FIG. 3 is a schematic representation showing a process for producing a leather-like sheet according to an embodiment of the present invention. In this production process, a moisture-curable polyurethane hot-melt resin composition (not shown in the drawing), produced by mixing a heated and melted hot-melt urethane prepolymer (A) and a colorant (B) using a two-components continuous mixing device 5, is poured between a pair of heated application rollers 6 between which is sandwiched a releasable substrate 1, thereby applying a uniform thickness of the moisture-curable polyurethane hot-melt resin composition to the surface of the releasable substrate 1 in a sheet-like manner.

Immediately following this application, the coated layer of the moisture-curable polyurethane hot-melt resin composition formed on top of the releasable substrate 1 and a fibrous substrate 3 are pressed together by passage between the application roller 6 and a press roller 7, yielding the targeted leather-like sheet 4*a* (not shown in the drawing). The thus obtained leather-like sheet 4*a* has the same structure as that shown in FIG. 1.

Figure 4:
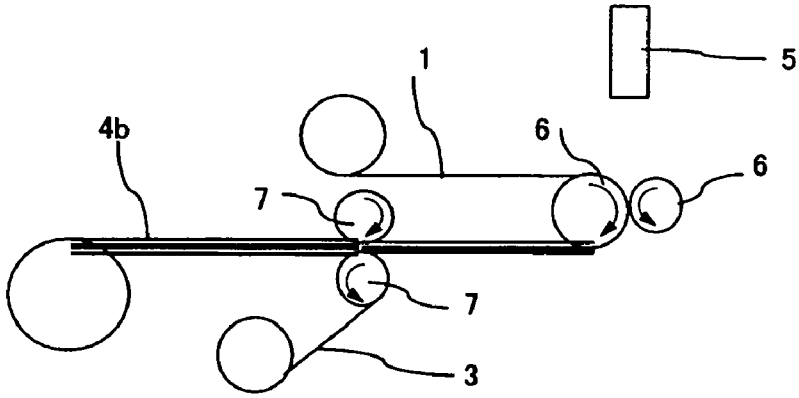
FIG. 4 is a schematic representation showing a process for producing a leather-like sheet that uses a moisture-curable polyurethane hot-melt resin composition according to an embodiment of the present invention.

FIG. 4 is a schematic representation showing a process for producing a leather-like sheet according to one embodiment of the present invention. In this production process, a moisture-curable polyurethane hot-melt resin composition (not shown in the drawing), produced by mixing a heated and melted hot-melt urethane prepolymer (A) and a colorant (B) using a two-components continuous mixing device 5, is poured between a pair of heated application rollers 6 between which is sandwiched a releasable substrate 1, thereby applying a uniform thickness of the moisture-curable polyurethane hot-melt resin composition to the surface of the releasable substrate 1 in a sheet-like manner.

Subsequently, the coated layer of the moisture-curable polyurethane hot-melt resin composition formed on top of the releasable substrate 1 and a fibrous substrate 3 are pressed together by passage between a pair of press rollers 7, yielding the targeted leather-like sheet 4*b* (not shown in the drawing). The thus obtained leather-like sheet 4*b* has the same structure as that shown in FIG. 1.

Figure 5:
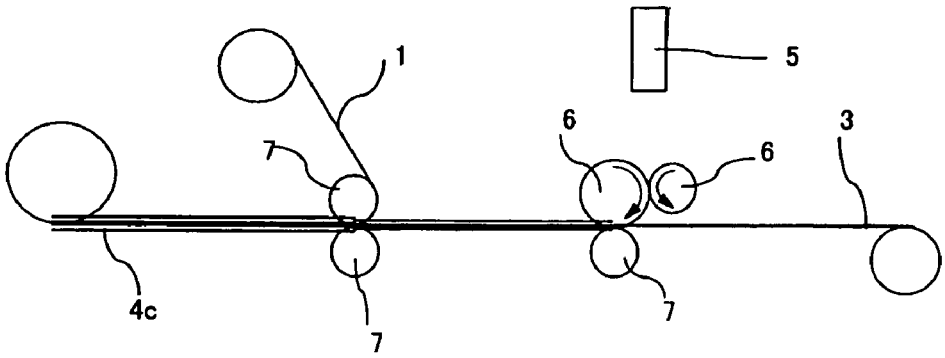
FIG. 5 is a schematic representation showing a process for producing a leather-like sheet that uses a moisture-curable polyurethane hot-melt resin composition according to an embodiment of the present invention.

FIG. 5 is a schematic representation showing a process for producing a leather-like sheet according to one embodiment of the present invention. In this production process, a moisture-curable polyurethane hot-melt resin composition (not shown in the drawing), produced by mixing a heated and melted hot-melt urethane prepolymer (A) and a colorant (B) using a two-components continuous mixing device 5, is poured between a pair of heated application rollers 6, thereby applying a uniform thickness of the moisture-curable polyurethane hot-melt resin composition to the surface of a fibrous substrate 3.

Subsequently, the coated layer of the moisture-curable polyurethane hot-melt resin composition formed on top of the fibrous substrate 3 and a releasable substrate 1 are pressed together by passage between a pair of press rollers 7, yielding the targeted leather-like sheet 4*c* (not shown in the drawing). The thus obtained leather-like sheet 4*c* has the same structure as that shown in FIG. 1.

EXAMPLES

As follows is a description of specifics of the present invention based on a series of examples, although the invention is in no way restricted to the examples presented below. In the following description, unless otherwise stated, the units "parts" and "%" refer to mass referenced values. The various properties were measured in accordance with the following methods.

(Method of Measuring Number Average Molecular Weight (Mn))

The molecular weight was measured using a gel permeation chromatography (GPC) method, and expressed as a polystyrene-equivalent number average molecular weight (Mn).

(Method of Measuring Melt Viscosity)

The melt viscosity (mPa·s) of each of the hot-melt urethane prepolymers obtained in the Examples and Comparative Examples was measured using a cone-plate viscometer (manufactured by ICI Ltd.), at a measurement temperature of 125° C.

(Method of Measuring Glass Transition Temperature (Tg))

The glass transition temperature (Tg) of the cured products from each of the hot-melt urethane prepolymer obtained in the examples and Comparative Examples was measured by applying the hot-melt urethane prepolymer at a thickness of 150 μm, subsequently aging the prepolymer for 5 days under conditions including an atmospheric temperature of 23° C. and a relative humidity of 65% to form a film, and then measuring this film using a dynamic viscoelasticity measurement device (manufactured by Rheometrics, Inc.) under conditions including a frequency of 1 Hz and a rate of temperature increase of 5° C./minute, with the Tg value indicated by the peak temperature (° C.) of the resulting loss tangent (tan δ).

(Method of Evaluating Color Uniformity)

The color uniformity of each of the leather-like sheets obtained in the Examples and Comparative Examples was evaluated visually and evaluated using the following 4-step scale.

A: extremely good
B: good
C: some color irregularities or discoloration
D: significant color irregularities or discoloration (Method of Evaluating Texture)

Each of the leather-like sheets obtained in the Examples and Comparative Examples was grasped and folded by hand, and the texture was evaluated using the following 5-step scale.

1: extremely soft
2: quite soft
3: soft
4: a little hard
5: quite hard (Method of Evaluating Abrasion Resistance)

The surface of each of the leather-like sheets obtained in the Examples and Comparative Examples was subjected to 1,000 abrasion cycles with a 1 kg load using an abrasion wheel CS-10, and the tabor abrasion (mg) that represents the weight reduction, and any visual changes in the external appearance of the sheet were evaluated using the following 4-step scale.

A: extremely good
B: good
C: some surface deterioration
D: significant surface deterioration (Method of Measuring Flex Resistance)

The flex resistance of each of the leather-like sheets obtained in the Examples and Comparative Examples was evaluated by inspecting the external appearance of the sheet following testing with a flexometer (manufactured by Toyo Seiki Seisaku-Sho, Ltd.) under conditions including 200,000 repetitions at room temperature (23° C.) and 100,000 repetitions at low temperature (−10° C.).

A: extremely good
B: good
C: some surface cracking
D: significant surface cracking (Method of Evaluating Reproducibility of an Indentation Pattern)

The indentation pattern of each of the leather-like sheets obtained in the Examples and Comparative Examples was compared with the surface indentation pattern of a sample of the release paper included within a sample booklet, and the reproducibility of the pattern was evaluated visually.

A: reproduced extremely faithfully
D: fine indentations partially missing, variations in surface luster, poor reproducibility (Method of Evaluating Adhesiveness)

A fabric hot-melt tape (trade name: MELCO TAPE, manufactured by San Chemicals, Ltd.) was bonded to the surface of each of the leather-like sheets obtained in the Examples and Comparative Examples using thermocompression bonding at 130° C. for 5 seconds, and the adhesiveness was then evaluated by measuring the peel strength in accordance with JIS K6854-2, using a testing machine TENSILON (manufactured by Shimadzu Corporation) and a head speed of 200 mm/minute.

(Method of Evaluating Hydrolysis Resistance)

Each of the leather-like sheets obtained in the Examples and Comparative Examples was subjected to a hydrolysis resistance test (accelerated test conditions: held at a temperature of 70° C. and a relative humidity of 95% for 10 weeks), the peel strength was measured in the same manner as in the adhesiveness evaluation described above, any visual changes in the external appearance following evaluation were noted, and the hydrolysis resistance was evaluated in accordance with the following criteria.

A: absolutely no changes in external appearance following accelerated test

B: localized changes in external appearance following accelerated test

D: changes in external appearance across the entire sheet following accelerated test (Method of Preparing Colorants (B))

A vehicle (B-1) used in the Examples and Comparative Examples, and various pigments (B-2) that had been dewatered by drying for one day at a temperature of 60° C. were combined in accordance with the blends shown in Tables 1 through 5, and each of the resulting mixtures was then stirred and mixed for 30 minutes until a uniform mixture was obtained, using a table-top ball mill under conditions including a temperature of 60° C. and a speed of 1,000 rpm, thus yielding a series of colorants (B).

Example 1

<<Process for Producing Leather-like Sheet 1>>

In accordance with the blend shown in Table 1, a 1 liter four-necked flask was charged with 70 parts of a polytetramethylene glycol (hereafter abbreviated as PTMG) with a number average molecular weight of 2,000, and 30 parts of a polyester polyol with a number average molecular weight of 2,000, produced by reacting adipic acid (abbreviated as AA in Tables 1 through 5) and 1,6-hexanediol (abbreviated as HG in Tables 1 through 5), and the mixture was heated under reduced pressure at 120° C., and dewatered until the moisture content had fallen to 0.05%. Subsequently, following cooling to 60° C., 15.0 parts of xylylene diisocyanate (abbreviated as XDI in Tables 1 through 5) and 0.01 parts of the catalyst di-n-butyltin dilaurate were added, the temperature was raised to 110° C., and the mixture was reacted for 5 hours until the isocyanate group content became constant, thus yielding a hot-melt urethane prepolymer 1. The melt viscosity of the prepolymer 1 at 125° C. was 4,000 mPa·s, the isocyanate group content was 2.1% by mass, and the glass transition temperature (Tg) was −30° C.

The prepolymer 1 obtained above, and a colorant 1, prepared using polypropylene glycol (abbreviated as PPG in Tables 1 through 5) with a number average molecular weight of 5,000 as the vehicle (B-1) and a titanium oxide-based pigment as the pigment (B-2) with a mixing ratio of vehicle (B-1)/pigment (B-2)=60/40 (mass ratio), were each heated to 60° C. Using a mixing ratio of prepolymer 1/colorant 1=100/20 (mass ratio), the two components were then mixed together using a two-components continuous mixing device set to 120° C., thereby yielding a colored moisture-curable polyurethane hot-melt resin composition 1.

The thus obtained colored moisture-curable polyurethane hot-melt resin composition 1 was supplied to a release paper (DE-123 (pore-like pattern), manufactured by Dainippon Printing Co., Ltd.) set on a roll coater heated to a temperature of 120° C., and was coated onto the release paper in a sheet-like manner to form a coating with a thickness of 150 μm. Subsequently, while still tacky, the coated surface was bonded to a urethane-impregnated nonwoven fabric, and the resulting laminate was then allowed to stand for 5 days in an atmosphere at 23° C. and a relative humidity of 65%, thus yielding a white leather-like sheet 1 with a pore-like pattern. The urethane-impregnated nonwoven fabric used was an intertwined nonwoven fabric formed from a microfiber bundle with a single fiber fineness of 0.1 decitex, which had been impregnated with polyurethane that had been subsequently solidified, thus yielding a fabric with a thickness of 1.3 mm. The results of evaluating the properties of the leather-like sheet 1 are shown in Table 1. The leather-like sheet 1 had a pore-like pattern that was a faithful reproduction of the indentation pattern of the release paper, and also exhibited excellent properties of color uniformity, texture, abrasion resistance, flex resistance, adhesiveness, and hydrolysis resistance. This leather-like sheet is ideal as the material for a sports shoe upper.

Example 2

<<Process for Producing Leather-like Sheet 2>>

The colored moisture-curable polyurethane hot-melt resin composition 1 obtained in the Example 1 was supplied to a roll coater heated to a set temperature of 120° C., and was coated directly onto the same urethane-impregnated non-woven fabric used in the Example 1 in sufficient quantity to generate a coating thickness of 150 μm. Subsequently, while still tacky, the coated surface was bonded to a release paper (DE-123 (pore-like pattern), manufactured by Dainippon Printing Co., Ltd.), and the resulting laminate was then allowed to stand for 5 days in an atmosphere at 23° C. and a relative humidity of 65%, thus yielding a leather-like sheet 2. The results of evaluating the properties of the leather-like sheet 2 are shown in Table 1. The leather-like sheet 2 had a pore-like pattern that was a faithful reproduction of the indentation pattern of the release paper, and also exhibited excellent properties of color uniformity, texture, abrasion resistance, flex resistance, adhesiveness, and hydrolysis resistance. This leather-like sheet is ideal as the material for a sports shoe upper.

Example 3

<<Process for Producing Leather-like Sheet 3>>

In accordance with the blend shown in Table 1, the hot-melt urethane prepolymer 1 obtained in the same manner as the Example 1, and a colorant 2, prepared using polypropylene glycol with a number average molecular weight of 15,000 as the vehicle (B-1) and a titanium oxide-based pigment as the pigment (B-2) with a mixing ratio of vehicle (B-1)/pigment (B-2)=60/40 (mass ratio), were each heated to 60° C. Using a mixing ratio of prepolymer 1/colorant 2=100/20 (mass ratio), the two components were then mixed together using a two-components continuous mixing device set to 120° C., thereby yielding a colored moisture-curable polyurethane hot-melt resin composition 2.

Using the thus obtained colored moisture-curable polyurethane hot-melt resin composition 2, a leather-like sheet 3 was produced using the same conditions and method as the Example 1. The results of evaluating the properties of the leather-like sheet 3 are shown in Table 1. The leather-like sheet 3 had a pore-like pattern that was a faithful reproduction of the indentation pattern of the release paper, and also exhibited excellent properties such as color uniformity, texture, abrasion resistance, flex resistance, adhesiveness, and hydrolysis resistance. This leather-like sheet is ideal as the material for a sports shoe upper.

Example 4

<<Process for Producing Leather-like Sheet 4>>

In accordance with the blend shown in Table 1, the hot-melt urethane prepolymer 1 obtained in the same manner as the Example 1, and a colorant 3, prepared using a propylene oxide adduct of glycerol (abbreviated as G-PPG in Table 1) with a number average molecular weight of 3,000 as the vehicle (B-1) and a titanium oxide-based pigment as the pigment (B-2) with a mixing ratio of vehicle (B-1)/pigment (B-2)=60/40 (mass ratio), were each heated to 60° C. Using a mixing ratio of prepolymer 1/colorant 3=100/20 (mass ratio), the two components were then mixed together using a two-components continuous mixing device set to 120° C., thereby yielding a colored moisture-curable polyurethane hot-melt resin composition 3.

Using the thus obtained colored moisture-curable polyurethane hot-melt resin composition 3, a leather-like sheet 4 was produced using the same conditions and method as the Example 1. The results of evaluating the properties of the leather-like sheet 4 are shown in Table 1. The leather-like sheet 4 had a pore-like pattern that was a faithful reproduction of the indentation pattern of the release paper, and also exhibited excellent properties such as color uniformity, texture, abrasion resistance, flex resistance, adhesiveness, and hydrolysis resistance. This leather-like sheet is ideal as the material for a sports shoe upper.

Example 5

In accordance with the blend shown in Table 2, a prepolymer 1 was prepared in the same manner as the Example 1, and to this prepolymer were added 8.0 parts of γ-phenylaminopropyltrimethoxysilane and 1.0 parts of AP-1 (an acidic phosphate ester, manufactured by Daihachi Chemical Industry Co., Ltd.), and the resulting mixture was reacted for 2 hours, yielding a hot-melt urethane prepolymer 2. The melt viscosity of the prepolymer 2 at 125° C. was 6,500 mPa·s, the isocyanate group content was 1.0% by mass, and the glass transition temperature (Tg) was −35° C.

The thus obtained prepolymer 2 and the colorant 1 prepared in the same manner as the Example 1 were each heated to 60° C., and using a mixing ratio of prepolymer 2/colorant 1=100/20 (mass ratio), the two components were then mixed together using a two-components continuous mixing device set to 120° C., thereby yielding a colored moisture-curable polyurethane hot-melt resin composition 4.

Using the thus obtained colored moisture-curable polyurethane hot-melt resin composition 4, a leather-like sheet 5 was produced using the same conditions and method as the Example 1. The results of evaluating the properties of the leather-like sheet 5 are shown in Table 2. The leather-like sheet 5 had a pore-like pattern that was a faithful reproduction of the indentation pattern of the release paper, and as a result of improved wetting characteristics relative to the pigment, also exhibited even more superior properties of color uniformity, as well as excellent properties of texture, abrasion resistance, flex resistance, adhesiveness, and hydrolysis resistance. This leather-like sheet is ideal as the material for a sports shoe upper.

Example 6

<<Process for Producing Leather-like Sheet 6>>

A hot-melt urethane prepolymer 3 obtained in accordance with the blend shown in Table 2, and the colorant 1 prepared in the same manner as the Example 1 were each heated to 60° C., and using a mixing ratio of prepolymer 3/colorant 1=100/20 (mass ratio), the two components were then mixed together using a two-components continuous mixing device set to 120° C., thereby yielding a colored moisture-curable polyurethane hot-melt resin composition 5.

Using the thus obtained colored moisture-curable polyurethane hot-melt resin composition 5, a leather-like sheet 6 was produced using the same conditions and method as the Example 1. The results of evaluating the properties of the leather-like sheet 6 are shown in Table 2. The leather-like sheet 6 had a pore-like pattern that was a faithful reproduction of the indentation pattern of the release paper, and also exhibited excellent properties such as color uniformity, texture, abrasion resistance, flex resistance, adhesiveness, and hydrolysis resistance. This leather-like sheet is ideal as the material for a sports shoe upper, the material for a soccer ball and the like.

Example 7

<<Process for producing leather-like sheet 7>>

A hot-melt urethane prepolymer 4 obtained in accordance with the blend shown in Table 2, and the colorant 1 prepared in the same manner as the Example 1 were each heated to 60° C., and using a mixing ratio of prepolymer 4/colorant 1=100/20 (mass ratio), the two components were then mixed together using a two-components continuous mixing device set to 120° C., thereby yielding a colored moisture-curable polyurethane hot-melt resin composition 6.

Using the thus obtained colored moisture-curable polyurethane hot-melt resin composition 6, a leather-like sheet 7 was produced using the same conditions and method as the Example 1. The results of evaluating the properties of the leather-like sheet 7 are shown in Table 2. The leather-like sheet 7 had a pore-like pattern that was a faithful reproduction of the indentation pattern of the release paper, and although the texture was slightly hard, also exhibited excellent properties of color uniformity, abrasion resistance, flex resistance, adhesiveness, and hydrolysis resistance. This leather-like sheet is ideal as the material for a sports shoe upper, the material for a soccer ball and the like.

Example 8

<<Process for producing leather-like sheet 8>>

In accordance with the blend shown in Table 2, the hot-melt urethane prepolymer 1 obtained in the same manner as the Example 1, and a colorant 4, prepared using a polytetramethylene glycol (abbreviated as PTMG in Table 2) with a number average molecular weight of 2,000 as the vehicle (B-1) and a titanium oxide-based pigment as the pigment (B-2) with a mixing ratio of vehicle (B-1)/pigment (B-2)=60/40 (mass ratio), were each heated to 60° C., and using a mixing ratio of prepolymer 1/colorant 4=100/20 (mass ratio), the two components were then mixed together using a two-components continuous mixing device set to 120° C., thereby yielding a colored moisture-curable polyurethane hot-melt resin composition 7.

Using the thus obtained colored moisture-curable polyurethane hot-melt resin composition 7, a leather-like sheet 8 was produced using the same conditions and method as the Example 1. The results of evaluating the properties of the leather-like sheet 8 are shown in Table 2. The leather-like sheet 8 had a pore-like pattern that was a faithful reproduction of the indentation pattern of the release paper, and also exhibited excellent properties such as color uniformity, texture, abrasion resistance, flex resistance, adhesiveness, and hydrolysis resistance. This leather-like sheet is ideal as the material for a sports shoe upper, the material for a volleyball and the like.

Example 9

<<Process for producing leather-like sheet 9>>

A hot-melt urethane prepolymer 5 obtained in accordance with the blend shown in Table 3, and the colorant 1 prepared in the same manner as the Example 1 were each heated to 60° C., and using a mixing ratio of prepolymer 5/colorant 1=100/20 (mass ratio), the two components were then mixed together using a two-components continuous mixing device set to 120° C., thereby yielding a colored moisture-curable polyurethane hot-melt resin composition 8.

Using the thus obtained colored moisture-curable polyurethane hot-melt resin composition 8, a leather-like sheet 9 was produced using the same conditions and method as the Example 1. The results of evaluating the properties of the leather-like sheet 9 are shown in Table 3. The leather-like sheet 9 had a pore-like pattern that was a faithful reproduction of the indentation pattern of the release paper, and also exhibited excellent properties of color uniformity, texture, abrasion resistance, flex resistance, adhesiveness, and hydrolysis resistance. This leather-like sheet is ideal as the material for a sports shoe upper, the material for a soccer ball and the like.

Example 10

<<Process for producing leather-like sheet 10>>

A hot-melt urethane prepolymer 6 obtained in accordance with the blend shown in Table 3, and a colorant 5, prepared using a polypropylene glycol (abbreviated as PPG in Table 3) with a number average molecular weight of 5,000 as the vehicle (B-1) and carbon black as the pigment (B-2) with a mixing ratio of vehicle (B-1)/pigment (B-2)=30/70 (mass ratio), were each heated to 60° C. Using-a mixing ratio of prepolymer 6/colorant 5=100/20 (mass ratio), the two components were then mixed together using a two-components continuous mixing device set to 120° C., thereby yielding a colored moisture-curable polyurethane hot-melt resin composition 9.

Using the thus obtained colored moisture-curable polyurethane hot-melt resin composition 9, a leather-like sheet 10 was produced using the same conditions and method as the Example 1. The results of evaluating the properties of the leather-like sheet 10 are shown in Table 3. The leather-like sheet 10 had a pore-like pattern that was a faithful reproduction of the indentation pattern of the release paper, and also exhibited excellent properties of color uniformity, texture, abrasion resistance, flex resistance, adhesiveness, and hydrolysis resistance. This leather-like sheet is ideal as the skin-like material for a reception room sofa, a vehicle seat, the upper for men's or women's shoes and the like.

Example 11

<<Process for producing leather-like sheet 11>>

In accordance with the blend shown in Table 3, the hot-melt urethane prepolymer 1 obtained in the same manner as the Example 1, and the colorant 5 prepared in the same manner as the Example 10 were each heated to 60° C., and using a mixing ratio of prepolymer 1/colorant 5=100/20 (mass ratio), the two components were then mixed together using a two-components continuous mixing device set to 120° C., thereby yielding a colored moisture-curable polyurethane hot-melt resin composition 10.

Using the thus obtained colored moisture-curable polyurethane hot-melt resin composition 10, a leather-like sheet 11 was produced using the same conditions and method as the Example 1. The results of evaluating the properties of the leather-like sheet 11 are shown in Table 3. The leather-like sheet 11 had a pore-like pattern that was a faithful reproduction of the indentation pattern of the release paper, and also exhibited excellent properties of color uniformity, texture, abrasion resistance, flex resistance, adhesiveness, and hydrolysis resistance. This leather-like sheet is ideal as the skin-like material for a reception room sofa, the upper for men's or women's shoes and the like.

Example 12

<<Process for producing leather-like sheet 12>>

In accordance with the blend shown in Table 3, the hot-melt urethane prepolymer 1 obtained in the same manner as the Example 1, and a colorant 6, prepared using a polypropylene glycol (abbreviated as PPG in Table 3) with a number average molecular weight of 5,000 as the vehicle (B-1) and phthalocyanine blue as the pigment (B-2) with a mixing ratio of vehicle (B-1)/pigment (B-2)=30/70 (mass ratio), were each heated to 60° C., and using a mixing ratio of prepolymer 1/colorant 6=100/20 (mass ratio), the two components were then mixed together using a two-components continuous mixing device set to 120° C., thereby yielding a colored moisture-curable polyurethane hot-melt resin composition 11.

Using the thus obtained colored moisture-curable polyurethane hot-melt resin composition 11, a leather-like sheet 12 was produced using the same conditions and method as the Example 1. The results of evaluating the properties of the leather-like sheet 12 are shown in Table 3. The leather-like sheet 12 had a pore-like pattern that was a faithful reproduction of the indentation pattern of the release paper, and also exhibited excellent properties of color uniformity, texture, abrasion resistance, flex resistance, adhesiveness, and hydrolysis resistance. This leather-like sheet is ideal as the material for a bag, the upper for a sports shoe and the like.

Example 13

<<Process for producing leather-like sheet 13>>

In accordance with the blend shown in Table 4, the hot-melt urethane prepolymer 1 obtained in the same manner as the Example 1, and a colorant 7, prepared using a polypropylene glycol (abbreviated as PPG in Table 4) with a number average molecular weight of 5,000 as the vehicle (B-1) and a soluble azo-based red pigment as the pigment (B-2) with a mixing ratio of vehicle (B-1)/pigment (B-2)=30/70 (mass ratio), were each heated to 60° C., and using a mixing ratio of prepolymer 1/colorant 7=100/20 (mass ratio), the two components were then mixed together using a two-components continuous mixing device set to 120° C., thereby yielding a colored moisture-curable polyurethane hot-melt resin composition 12.

With the exceptions of using the thus obtained colored moisture-curable polyurethane hot-melt resin composition 12, using a release paper DE-125 (with a cordovan-like indentation pattern, manufactured by Dainippon Printing Co., Ltd.), and applying the composition in a sheet-like manner with a thickness of 350 μm, a leather-like sheet 13 was produced using the same conditions and method as the Example 1. The urethane-impregnated nonwoven fabric used was an intertwined nonwoven fabric formed from a microfiber bundle with a single fiber fineness of 0.1 decitex, which had been impregnated with polyurethane that had been subsequently solidified, and then surface-coated with a wet polyurethane that had been subsequently solidified, thus yielding a fabric with a thickness of 1.5 mm that included a porous layer of thickness 200 μm. The results of evaluating the properties of the leather-like sheet 13 are shown in Table 4. The leather-like sheet 13 had a cordovan-like indentation pattern that was a faithful reproduction of the indentation pattern of the release paper, exhibited excellent smoothness, was resistant to buckling-type wrinkles when folded, and also exhibited excellent properties such as color uniformity, texture, abrasion resistance, flex resistance, adhesiveness, and hydrolysis resistance. This leather-like sheet is ideal as the material for bags, uppers for men's or women's shoes, the material for purses and the like.

Comparative Example 1

<<Process for producing leather-like sheet 14>>

In accordance with the blend shown in Table 4, the hot-melt urethane prepolymer 1 obtained in the same manner as the Example 1, and a colorant 8, prepared using the plasticizer dioctyl phthalate (abbreviated as DOP in Table 4) as the vehicle (B-1) and titanium oxide as the pigment (B-2) with a mixing ratio of vehicle (B-1)/pigment (B-2)=60/40 (mass ratio), were each heated to 60° C. Using a mixing ratio of prepolymer 1/colorant 8=100/20 (mass ratio), the two components were then mixed together using a two-components continuous mixing device set to 120° C., thereby yielding a colored moisture-curable polyurethane hot-melt resin composition 13.

Using the thus obtained colored moisture-curable polyurethane hot-melt resin composition 13, a leather-like sheet 14 was produced using the same conditions and method as the Example 1. The results of evaluating the properties of the leather-like sheet 14 are shown in Table 4. The leather-like sheet 14 had a pore-like pattern that was a faithful reproduction of the indentation pattern of the release paper, and exhibiting favorable properties of color uniformity and flex resistance. However, the plasticizer bled from the surface of the leather-like sheet, and the texture, abrasion resistance, adhesiveness and hydrolysis resistance were extremely poor.

Comparative Example 2

<<Process for producing leather-like sheet 15>>

In accordance with the blend shown in Table 4, the hot-melt urethane prepolymer 1 obtained in the same manner as the Example 1, and a colorant 9, prepared using a propylene glycol (abbreviated as PPG in Table 4) with a number average molecular weight of 700 as the vehicle (B-1) and titanium oxide as the pigment (B-2) with a mixing ratio of vehicle (B-1)/pigment (B-2)=60/40 (mass ratio), were each heated to 60° C. Using a mixing ratio of prepolymer 1/colorant 9=100/20 (mass ratio), the two components were then mixed together using a two-components continuous mixing device set to 120° C., thereby yielding a colored moisture-curable polyurethane hot-melt resin composition 14.

Using the thus obtained colored moisture-curable polyurethane hot-melt resin composition 14, a leather-like sheet 15 was produced using the same conditions and method as the Example 1. The results of evaluating the properties of the leather-like sheet 15 are shown in Table 4. With the leather-like sheet 15, the melt viscosity of the composition 14 increased during processing, causing spots at various locations on the sheet, and the color uniformity, texture, and abrasion resistance were extremely poor.

Comparative Example 3

<<Process for producing leather-like sheet 16>>

In accordance with the blend shown in Table 4, the hot-melt urethane prepolymer 1 obtained in the same manner as the Example 1, and a colorant 10, prepared using a propylene glycol (abbreviated as PPG in Table 4) with a number average molecular weight of 25,000 as the vehicle (B-1) and titanium oxide as the pigment (B-2) with a mixing ratio of vehicle (B-1)/pigment (B-2)=60/40 (mass ratio), were each heated to 60° C. Using a mixing ratio of prepolymer 1/colorant 10=100/20 (mass ratio), the two components were then mixed together using a two-components continuous mixing device set to 120° C., thereby yielding a colored moisture-curable polyurethane hot-melt resin composition 15.

Using the thus obtained colored moisture-curable polyurethane hot-melt resin composition 15, a leather-like sheet 16 was produced using the same conditions and method as the Example 1. The results of evaluating the properties of the leather-like sheet 16 are shown in Table 4. With the leather-like sheet 16, the melt viscosity of the composition 16 decreased during processing, causing excessive penetration of the composition into the urethane-impregnated nonwoven fabric, and moreover the texture was hard, and the abrasion resistance was poor.

Comparative Example 4

<<Process for producing leather-like sheet 17>>

In accordance with the blend shown in Table 5, the hot-melt urethane prepolymer 1 obtained in the same manner as the Example 1, and a colorant 11, prepared using a low molecular weight polyethylene (abbreviated as PE in Table 5) as the vehicle (B-1) and titanium oxide as the pigment (B-2) with a mixing ratio of vehicle (B-1)/pigment (B-2)=65/35 (mass ratio), were each heated to 60° C. Using a mixing ratio of prepolymer 1/colorant 11=100/40 (mass ratio), the two components were then mixed together using a two-components continuous mixing device set to 120° C., thereby yielding a colored moisture-curable polyurethane hot-melt resin composition 16.

Using the thus obtained colored moisture-curable polyurethane hot-melt resin composition 16, a leather-like sheet 17 was produced using the same conditions and method as the Example 1. The results of evaluating the properties of the leather-like sheet 17 are shown in Table 5. In the leather-like sheet 17, the compatibility of the prepolymer 1 and the colorant 11 was inferior, and the color uniformity and abrasion resistance were extremely poor.

Comparative Example 5

<<Process for producing leather-like sheet 18>>

A polyester diol (abbreviated as PMPA in Table 5) with a number average molecular weight of 2,000, obtained by a condensation reaction between 3-methyl-1,5-pentanediol and adipic acid, as the polyol, 1,4-butanediol (abbreviated as 1,4-BD in Table 5) as a chain extender, and 4,4'-diphenylmethane diisocyanate (abbreviated as 4,4'-MDI in Table 5) as the polyisocyanate were supplied continuously via a constant rate pump to a biaxial screw-type extruder (30 mm ϕ(diameter), L/D=36) that rotated coaxially, thereby conducting a continuous melt polymerization at 260° C. The resulting molten thermoplastic polyurethane resin was extruded into water as a continuous strand and then cut with a pelletizer, and the resulting pellets were dewatered and dried for 6 hours at 80° C., thereby yielding a thermoplastic polyurethane resin for molten surface formation (number average molecular weight: 150,000).

Using the thus obtained thermoplastic polyurethane resin as the vehicle (B-1), and the same pigment (B-2) as the Example 13, pelletization was conducted in the same manner as described above using a mixing ratio of vehicle (B-1)/pigment (B-2)=65/35 (mass ratio), thus yielding a colorant 12. The above thermoplastic polyurethane resin and the colorant 12 were mixed together using a mixing ratio of thermoplastic polyurethane resin/colorant 12=100/40 (mass ratio), and the resulting mixture was dewatered and dried for 8 hours in a low dew point dryer. Subsequently, the mixture was heated to 210° C., and using a nitrogen-sealed T-die extruder, was applied by melt extrusion to the surface of the same release paper as that used in the Example 13 (DE-125 (with a cordovan-like indentation pattern, manufactured by Dainippon Printing Co., Ltd.)), in sufficient quantity to form a film with a thickness of 350 μm. Before cooling and solidification, the molten-state colored thermoplastic polyurethane resin composition was bonded to a urethane-impregnated nonwoven fabric containing a porous layer similar to that of the Example 13 using a press roller, and the resulting laminate was then left to stand for one day before the release paper was removed, yielding a leather-like sheet 18.

The results of evaluating the properties of the leather-like sheet 18 are shown in Table 5. In the leather-like sheet 18, the reproducibility of the cordovan-like indentation pattern was poor, with the fine indentation pattern partially missing and areas of different surface luster also apparent, and discoloration of the colorant 12 meant that the targeted vividness of the red color was missing, leading to a poor external appearance.

The names of the raw materials abbreviated in the Tables 1 through 5 are as follows:

PTMG: polytetramethylene glycol
PPG: polypropylene glycol
HG: 1,6-hexanediol
AA: adipic acid
HG/AA: polyester polyol of 1,6 hexanediol and adipic acid
G-PPG: propylene oxide adduct of glycerol
PC: polycarbonate diol
PMPA: polyester polyol of 3-methyl-1,5-pentanediol and adipic acid
1,4-BD: 1,4-butanediol
XDI: xylylene diisocyanate
4,4'-MDI: 4,4'-diphenylmethane diisocyanate
DBTDL: di-n-butyltin dilaurate
DOP: dioctyl phthalate
PE: low molecular weight polyethylene

TABLE 1

Table 1

| | Example 1 | Example 2 | Example 3 | Example 4 |
|---|---|---|---|---|
| Prepolymer composition (parts by mass) | | | | |
| PTMG (molecular weight: 2,000) | 70 | 70 | 70 | 70 |
| HG/AA (molecular weight: 2,000) | 30 | 10 | 30 | 30 |

TABLE 1-continued

Table 1

| | Example 1 | Example 2 | Example 3 | Example 4 |
|---|---|---|---|---|
| XDI | 15.0 | 15.0 | 15.0 | 15.0 |
| DBTDL | 0.01 | 0.01 | 0.01 | 0.01 |
| Results of evaluating prepolymer properties | | | | |
| melt viscosity (mPa · s/125° C.) | 4,000 | 4,000 | 4,000 | 4,000 |
| isocyanate group content (% by mass) | 2.1 | 2.1 | 2.1 | 2.1 |
| Tg (° C.) | −30 | −30 | −30 | −30 |
| Colorant composition | Colorant 1 | Colorant 1 | Colorant 2 | Colorant 3 |
| vehicle | PPG | PPG | PPG | G-PPG |
| number average molecular weight | 5,000 | 5,000 | 15,000 | 3,000 |
| pigment | titanium oxide | titanium oxide | titanium oxide | titanium oxide |
| vehicle/pigment (mass ratio) | 60/40 | 60/40 | 60/40 | 60/40 |
| Colored resin composition | | | | |
| prepolymer/colorant (mass ratio) | 100/20 | 100/20 | 100/20 | 100/20 |
| Substrate to which resin composition is applied | release paper | fibrous substrate | release paper | release paper |
| Results of evaluating leather-like sheet properties | | | | |
| (1) coating thickness (μm) | 150 | 150 | 150 | 150 |
| (2) color uniformity | A | A | A | A |
| (3) texture (1: soft, 5: hard) | 1 | 1 | 1 | 1 |
| (4) abrasion resistance (tabor abrasion: mg) | 2 | 2 | 2 | 2 |
| external appearance following testing | A | A | A | A |
| (5) flexibility 23° C. × 200,000 repetitions | A | A | A | A |
| −10° C. × 100,000 repetitions | A | A | A | A |
| (6) adhesiveness: peel strength (kg/inch) | 7.5 | 7.0 | 6.0 | 6.2 |
| (7) hydrolysis resistance: | | | | |
| external appearance following testing | A | A | A | A |
| peel strength (kg/inch) | 6.0 | 6.5 | 5.5 | 5.5 |
| (8) reproducibility of indentation pattern | A | A | A | A |

TABLE 2

Table 2

| | Example 5 | Example 6 | Example 7 | Example 8 |
|---|---|---|---|---|
| Prepolymer composition (parts by mass) | | | | |
| PTMG (molecular weight: 2,000) | 70 | 40 | 30 | 70 |
| HG/AA (molecular weight: 2,000) | 30 | 60 | 70 | 30 |
| XDI | 15.0 | 15.0 | 15.0 | 15.0 |
| DBTDL | 0.01 | 0.01 | 0.01 | 0.01 |
| AP-1 (acidic phosphate ester) | 1.0 | | | |
| γ-phenylaminopropyltrimethoxysilane | 8.0 | | | |
| Results of evaluating prepolymer properties | | | | |
| melt viscosity (mPa · s/125° C.) | 6,500 | 4,000 | 4,500 | 4,000 |
| isocyanate group content (% by mass) | 1.0 | 2.1 | 2.1 | 2.1 |
| Tg (° C.) | −35 | −15 | 30 | −30 |
| Colorant composition | Colorant 1 | Colorant 1 | Colorant 1 | Colorant 4 |
| vehicle | PPG | PPG | PPG | PTMG |
| number average molecular weight | 5,000 | 5,000 | 5,000 | 2,000 |
| pigment | titanium oxide | titanium oxide | titanium oxide | titanium oxide |
| vehicle/pigment (mass ratio) | 60/40 | 60/40 | 60/40 | 60/40 |
| Colored resin composition | | | | |
| prepolymer/colorant (mass ratio) | 100/20 | 100/20 | 100/20 | 100/20 |
| Substrate to which resin composition is applied | release paper | release paper | release paper | release paper |
| Results of evaluating leather-like sheet properties | | | | |
| (1) coating thickness (μm) | 150 | 150 | 150 | 150 |
| (2) color uniformity | A | A | A | A |
| (3) texture (1: soft, 5: hard) | 1 | 2 | 3 | 1 |
| (4) abrasion resistance (tabor abrasion: mg) | 5 | 8 | 8 | 1 |
| external appearance following testing | A | A | A | A |
| (5) flexibility 23° C. × 200,000 repetitions | A | A | A | A |
| −10° C. × 100,000 repetitions | A | A | C | A |
| (6) adhesiveness: peel strength (kg/inch) | 6.5 | 7.5 | 5.5 | 7.5 |

TABLE 2-continued

| Table 2 | Example 5 | Example 6 | Example 7 | Example 8 |
|---|---|---|---|---|
| (7) hydrolysis resistance: | | | | |
| external appearance following testing | A | A | C | A |
| peel strength (kg/inch) | 5.5 | 7.3 | 3.5 | 7.5 |
| (8) reproducibility of indentation pattern | A | A | A | A |

TABLE 3

| Table 3 | Example 9 | Example 10 | Example 11 | Example 12 |
|---|---|---|---|---|
| Prepolymer composition (parts by mass) | | | | |
| PTMG (molecular weight: 2,000) | 70 | 70 | 70 | 70 |
| HG/AA (molecular weight: 2,000) | 30 | | 30 | 30 |
| PC (molecular weight: 2,000) | | 30 | | |
| XDI | | 15.0 | 15.0 | 15.0 |
| 4,4'-MDI | 25.0 | | | |
| DBTDL | | 0.01 | 0.01 | 0.01 |
| Results of evaluating prepolymer properties | | | | |
| melt viscosity (mPa · s/125° C.) | 6,000 | 4,000 | 4,000 | 4,000 |
| isocyanate group content (% by mass) | 3.3 | 2.2 | 2.1 | 2.1 |
| Tg (° C.) | −30 | −20 | −30 | −30 |
| Colorant composition | Colorant 1 | Colorant 5 | Colorant 5 | Colorant 6 |
| vehicle | PPG | PPG | PPG | PPG |
| number average molecular weight | 5,000 | 5,000 | 5,000 | 5,000 |
| pigment | titanium oxide | carbon black | carbon black | phthalocyanine blue |
| vehicle/pigment (mass ratio) | 60/40 | 30/70 | 30/70 | 30/70 |
| Colored resin composition | | | | |
| prepolymer/colorant (mass ratio) | 100/20 | 100/20 | 100/20 | 100/20 |
| Substrate to which resin composition is applied | release paper | release paper | release paper | release paper |
| Results of evaluating leather-like sheet properties | | | | |
| (1) coating thickness (μm) | 150 | 150 | 150 | 150 |
| (2) color uniformity | A | A | A | A |
| (3) texture (1: soft, 5: hard) | 2 | 2 | 1 | 1 |
| (4) abrasion resistance (tabor abrasion: mg) | 1 | 5 | 1 | 1 |
| external appearance following testing | A | A | A | A |
| (5) flexibility 23° C. × 200,000 repetitions | A | A | A | A |
| −10° C. × 100,000 repetitions | A | A | A | A |
| (6) adhesiveness: peel strength (kg/inch) | 7.5 | 7.2 | 7.0 | 7.2 |
| (7) hydrolysis resistance: | | | | |
| external appearance following testing | A | A | A | A |
| peel strength (kg/inch) | 7.2 | 7.0 | 6.8 | 7.0 |
| (8) reproducibility of indentation pattern | A | A | A | A |

TABLE 4

| Table 4 | Example 13 | Comparative Example 1 | Comparative Example 2 | Comparative Example 3 |
|---|---|---|---|---|
| Prepolymer composition (parts by mass) | | | | |
| PTMG (molecular weight: 2,000) | 70 | 70 | 70 | 70 |
| HG/AA (molecular weight: 2000) | 30 | 30 | 30 | 30 |
| XDI | 15.0 | 15.0 | 15.0 | 15.0 |
| DBTDL | 0.01 | 0.01 | 0.01 | 0.01 |
| Results of evaluating prepolymer properties | | | | |
| melt viscosity (mPa · s/125° C.) | 4,000 | 4,000 | 4,000 | 4,000 |
| isocyanate group content (% by mass) | 2.1 | 2.1 | 2.1 | 2.1 |
| Tg (° C.) | −30 | −30 | −30 | −30 |

TABLE 4-continued

Table 4

| | Example 13 | Comparative Example 1 | Comparative Example 2 | Comparative Example 3 |
|---|---|---|---|---|
| Colorant composition | Colorant 7 | Colorant 8 | Colorant 9 | Colorant 10 |
| vehicle | PPG | DOP | PPG | PPG |
| number average molecular weight | 5,000 | 380 | 700 | 25,000 |
| pigment | soluble azo red pigment | titanium oxide | titanium oxide | titanium oxide |
| vehicle/pigment (mass ratio) | 30/70 | 60/40 | 60/40 | 60/40 |
| Colored resin composition prepolymer/colorant (mass ratio) | 100/20 | 100/20 | 100/20 | 100/20 |
| Substrate to which resin composition is applied | release paper | release paper | release paper | release paper |
| Results of evaluating leather-like sheet properties | | | | |
| (1) coating thickness (μm) | 350 | 150 | 150 | 150 |
| (2) color uniformity | A | A | D | B |
| (3) texture (1: soft, 5: hard) | 4 | 3 | 3 | 3 |
| (4) abrasion resistance (tabor abrasion: mg) | 1 | 40 | 50 | 30 |
| external appearance following testing | A | C | D | D |
| (5) flexibility 23° C. × 200,000 repetitions | A | B | B | B |
| −10° C. × 100,000 repetitions | A | B | B | B |
| (6) adhesiveness: peel strength (kg/inch) | 7.5 | 4.5 | 6.0 | 5.5 |
| (7) hydrolysis resistance: | | | | |
| external appearance following testing | A | A | B | B |
| peel strength (kg/inch) | 7.0 | 0.5 | 6.0 | 5.5 |
| (8) reproducibility of indentation pattern | A | A | A | A |

TABLE 5

Table 5

| | Comparative Example 4 | Comparative Example 5 |
|---|---|---|
| Prepolymer composition (parts by mass) | | |
| PTMG (molecular weight: 2,000) | 70 | |
| HG/AA (molecular weight: 2,000) | 30 | |
| XDI | 15.0 | |
| DBTDL | 0.01 | |
| PMPA (molecular weight: 2,000) | | 62.1 |
| 1,4-BD | | 7.8 |
| 4,4'-MDI | | 30.1 |
| Results of evaluating prepolymer properties | | |
| melt viscosity (mPa · s/125° C.) | 4,000 | Did not melt (solid) |
| isocyanate group content (% by mass) | 2.1 | — |
| Tg (° C.) | −30 | — |
| Colorant composition | Colorant 11 | Colorant 12 |
| vehicle | PE | thermo-plastic polyurethane resin |
| pigment | titanium oxide | soluble azo red pigment |
| vehicle/pigment (mass ratio) | 65/35 | 65/35 |
| Colored resin composition prepolymer/colorant (mass ratio) | 100/40 | 100/40 |
| Substrate to which resin composition is applied | release paper | release paper |
| Results of evaluating leather-like sheet properties | | |
| (1) coating thickness (μm) | 150 | 350 |
| (2) color uniformity | D | D |
| (3) texture (1: soft, 5: hard) | 3 | 4 |
| (4) abrasion resistance (tabor abrasion: mg) | 200 | 5 |
| external appearance following testing | D | A |

TABLE 5-continued

Table 5

| | Comparative Example 4 | Comparative Example 5 |
|---|---|---|
| (5) flexibility 23° C. × 200,000 repetitions | B | A |
| −10° C. × 100,000 repetitions | B | D |
| (6) adhesiveness: peel strength (kg/inch) | 4.5 | 5.5 |
| (7) hydrolysis resistance: | | |
| external appearance following testing | B | A |
| peel strength (kg/inch) | 2.0 | 3.5 |
| (8) reproducibility of indentation pattern | A | D |

INDUSTRIAL APPLICABILITY

According to a production process of the present invention, a process for producing a leather-like sheet can be provided which uses no organic solvents, which have a deleterious effect on human health and cause pollution of the atmosphere or waterways, meaning drying and removal of the organic solvent during the production process is unnecessary, enabling significant reductions to be made in both the level of energy consumption and the production costs, and moreover, which is capable of producing a leather-like sheet which suffers no discoloration of the colorant during melting, offers excellent design properties with uniform coloring and no color irregularities, and exhibits excellent properties of texture, abrasion resistance, and softness and the like. Furthermore, according to the present invention, a method of producing a leather-like sheet with excellent design properties can be provided, wherein a skin-like layer with an indentation pattern that represents a faithful reproduction of the indentation pattern of a releasable substrate can be formed on top of a fibrous substrate.

Furthermore, according to the present invention, an additional step that is required in conventional techniques, wherein a skin-like layer is prepared in advance, and an adhesive is then used to bond this skin-like layer to a substrate, can be omitted, enabling a dramatic improvement in the efficiency of the production process.

In addition, according to the present invention, a production process can be provided which is capable of producing a leather-like sheet of excellent quality, which suffers no discoloration of the colorant due to heat or the like during melting and exhibits uniform coloring and no color irregularities, even when the skin-like layer has a large film thickness exceeding 200 μm.

Leather-like sheets obtained using these types of production processes of the present invention can be used in a wide range of applications, including footwear, furniture, clothing, vehicles, bags, storage cases and the like.

The invention claimed is:

1. A process for producing a leather-like sheet, wherein a skin-like layer composed of a resin composition (C) is formed on top of a fibrous substrate (E), the process comprising:

heating and melting a moisture-curable polyurethane hot-melt resin composition (C) which contains a hot-melt urethane prepolymer (A) having isocyanate groups at molecular terminal ends and a colorant (B), and applying said heated and melted resin composition (C) to either [1] a releasable substrate (D) and then bonding the coated surface to a fibrous substrate (E), or [2] a fibrous substrate (E) and then bonding the coated surface to a releasable substrate (D);

wherein the colorant (B) contains a polyol with a number average molecular weight within a range from 1,000 to 20,000 as a vehicle (B-1), and a pigment (B-2).

2. A process for producing a leather-like sheet according to claim 1, wherein said hot-melt urethane prepolymer (A) is obtained by reacting a polyol that comprises at least 40% by mass of polytetramethylene glycol with a polyisocyanate.

3. A process for producing a leather-like sheet according to either claim 1 or claim 2, wherein said polyol with a number average molecular weight within a range from 1,000 to 20,000 is a polyoxyalkylene glycol.

4. A process for producing a leather-like sheet according to either claim 1 or claim 2, wherein said releasable substrate has an indentation pattern.

5. A process for producing a leather-like sheet according to either claim 1 or claim 2, wherein said moisture-curable polyurethane hot-melt resin composition (C) is obtained by mixing said hot-melt urethane prepolymer (A) and said colorant (B) in a heated and melted state.

6. A process for producing a leather-like sheet according to claim 2, wherein said polyol that comprises at least 40% by mass of polytetramethylene glycol also comprises a polyester polyol.

7. A process for producing a leather-like sheet according to either claim 1 or claim 2, wherein said hot-melt urethane prepolymer (A) is a prepolymer which when subjected to moisture curing yields a cured product with a glass transition temperature within a range from −70 to 25° C.

8. A process for producing a leather-like sheet according to either claim 1 or claim 2, wherein said hot-melt urethane prepolymer (A) also contains hydrolysable alkoxysilyl groups at molecular terminal ends.

9. A process for producing a leather-like sheet according to either claim 1 or claim 2, wherein said polyisocyanate is xylylene diisocyanate.

10. A process for producing a leather-like sheet according to either claim 1 or claim 2, wherein an isocyanate group content within said hot-melt urethane prepolymer (A) is within a range from 0.5 to 10.0% by mass.

11. A process for producing a leather-like sheet according to either claim 1 or claim 2, wherein said hot-melt urethane prepolymer (A) has a melt viscosity at 125° C., measured using a cone-plate viscometer, within a range from 100 to 100,000 mPa·s.

12. A process for producing a leather-like sheet according to either claim 1 or claim 2, wherein said fibrous substrate (E) has a porous resin layer on a surface thereof.

13. A process for producing a leather-like sheet according to claim 1, the process further comprising the step of:

releasing substrate (D) from the resin composition (C), after the releasable substrate (D), the resin composition (C), and the fibrous substate (E) are laminated in this order.

* * * * *